US008814289B2

(12) United States Patent
Yamasaki

(10) Patent No.: US 8,814,289 B2
(45) Date of Patent: Aug. 26, 2014

(54) PRINT APPARATUS AND PRINT CONTROL METHOD

(75) Inventor: Shuichi Yamasaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 217 days.

(21) Appl. No.: 13/458,493

(22) Filed: Apr. 27, 2012

(65) Prior Publication Data

US 2012/0274683 A1 Nov. 1, 2012

(30) Foreign Application Priority Data

Apr. 28, 2011 (JP) ..... 2011-100438

(51) Int. Cl.

| | |
|---|---|
| ***B41J 3/00*** | (2006.01) |
| ***B41J 29/38*** | (2006.01) |
| ***B41J 3/407*** | (2006.01) |
| ***B41J 29/02*** | (2006.01) |
| ***B41J 29/13*** | (2006.01) |

(52) U.S. Cl.

CPC ..... *B41J 29/13* (2013.01); *B41J 3/4073* (2013.01); *B41J 29/02* (2013.01); *B41J 29/38* (2013.01)

USPC ..... 347/2; 347/3; 347/5; 347/9

(58) Field of Classification Search

USPC ..... 347/2, 3, 5, 9

See application file for complete search history.

(56) References Cited

U.S. PATENT DOCUMENTS

| | | | | |
|---|---|---|---|---|
| 5,931,166 | A * | 8/1999 | Weber et al. | 132/73 |
| 7,123,983 | B2 * | 10/2006 | Yogo et al. | 700/182 |
| 8,695,495 | B2 * | 4/2014 | Hashimoto | 101/35 |

FOREIGN PATENT DOCUMENTS

| | | | |
|---|---|---|---|
| JP | 3016147 | B1 | 7/2000 |
| JP | 2001-239652 | A | 9/2001 |
| JP | 2001239652 | A * | 9/2001 |
| JP | 2008-126505 | A | 6/2008 |
| JP | 2008126505 | A * | 6/2008 |

OTHER PUBLICATIONS

Japanese Office Action dated Jun. 11, 2013 (and English translation thereof) in counterpart Japanese Application No. 2011-100438.

* cited by examiner

*Primary Examiner* — Sarah Al Hashimi
(74) *Attorney, Agent, or Firm* — Holtz Holtz Goodman & Chick PC

(57) ABSTRACT

A print apparatus includes a selection unit, a print unit and control unit. The selection unit categorizes a curve-shape of a print target surface into one specific shape pattern among a plurality of shape patterns having shapes whose degrees of curving are different from each other. The print unit has a recording head that applies ink on the print target surface. The control unit controls the print unit to set an ink amount to be applied at the edge parts of the print target surface to predetermined amount which is set corresponding to the specific shape pattern.

16 Claims, 35 Drawing Sheets

FIG.14

SPRAYING FREQUENCY BASIS TABLE

| WIDTH POSITION [×100 μm] | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| NAIL SHAPE PATTERN A | 4 | 3 | 3 | 3 | 3 | 3 | 3 | 3 | 3 | 2 | 2 | 2 | 2 | 1 | 1 | 1 | 1 | 1 | 1 | 1 |
| NAIL SHAPE PATTERN B | 3 | 3 | 2 | 2 | 2 | 2 | 2 | 2 | 1 | 1 | 1 | 1 | 1 | 1 | 1 | 1 | 1 | 1 | 1 | 1 |
| NAIL SHAPE PATTERN C | 2 | 2 | 2 | 1 | 1 | 1 | 1 | 1 | 1 | 1 | 1 | 1 | 1 | 1 | 1 | 1 | 1 | 1 | 1 | 1 |

FIG.16

SPRAYING FREQUENCY ADJUSTMENT TABLE a0, b0 (a0 to b0 = 10000 μm)

| WIDTH POSITION [×100 μm] | 1 | 2 | 3 | 4 | 5 | 6 | 7 | 8 | 9 | 10 | 11 | 12 | 13 | 14 | 15 | 16 | 17 | 18 | 19 | 20 | 21 | 22 | ··· | 78 | 79 | 80 | 81 | 82 | 83 | 84 | 85 | 86 | 87 | 88 | 89 | 90 | 91 | 92 | 93 | 94 | 95 | 96 | 97 | 98 | 99 | 100 |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| SPRAYING FREQUENCY ADJUSTMENT TABLE a0, b0 | 4 | 3 | 3 | 3 | 3 | 3 | 3 | 3 | 3 | 2 | 2 | 2 | 2 | 1 | 1 | 1 | 1 | 1 | 1 | 1 | 1 | 1 | ··· | 1 | 1 | 1 | 1 | 1 | 1 | 1 | 1 | 1 | 1 | 2 | 2 | 2 | 2 | 3 | 3 | 3 | 3 | 3 | 3 | 3 | 3 | 4 |

PARTS HAVING VALUE 2 OR ABOVE (13 COLUMNS)

PARTS HAVING VALUE 1 (74 COLUMNS)

PARTS HAVING VALUE 2 OR ABOVE (13 COLUMNS)

FIG.17

SPRAYING FREQUENCY ADJUSTMENT TABLE a1, b1 (a1 to b1 = 8000 μm)

| WIDTH POSITION [×100 μm] | 1 | 2 | 3 | 4 | 5 | 6 | 7 | 8 | 9 | 10 | 11 | 12 | 13 | 14 | 15 | 16 | ··· | 64 | 65 | 66 | 67 | 68 | 69 | 70 | 71 | 72 | 73 | 74 | 75 | 76 | 77 | 78 | 79 | 80 |
|---|---|---|---|---|---|---|---|---|---|---|---|---|---|---|---|---|---|---|---|---|---|---|---|---|---|---|---|---|---|---|---|---|---|---|
| SPRAYING FREQUENCY ADJUSTMENT TABLE a1, b1 | 3 | 3 | 3 | 3 | 3 | 3 | 2 | 2 | 2 | 2 | 1 | 1 | 1 | 1 | 1 | 1 | ··· | 1 | 1 | 1 | 1 | 1 | 1 | 1 | 2 | 2 | 2 | 2 | 3 | 3 | 3 | 3 | 3 | 3 |

10 COLUMNS

60 COLUMNS (PARTS HAVING VALUE 1)

10 COLUMNS

FIG.18

SPRAYING FREQUENCY ADJUSTMENT TABLE a2, b2 (a2 to b2 = 5000 μm)

| WIDTH POSITION [×100 μm] | 1 | 2 | 3 | 4 | 5 | 6 | 7 | 8 | 9 | 10 | 11 | 12 | 13 | ··· | 37 | 38 | 39 | 40 | 41 | 42 | 43 | 44 | 45 | 46 | 47 | 48 | 49 | 50 |
|---|---|---|---|---|---|---|---|---|---|---|---|---|---|---|---|---|---|---|---|---|---|---|---|---|---|---|---|---|
| SPRAYING FREQUENCY ADJUSTMENT TABLE a2, b2 | 3 | 3 | 3 | 2 | 2 | 2 | 2 | 1 | 1 | 1 | 1 | 1 | 1 | ··· | 1 | 1 | 1 | 1 | 1 | 1 | 1 | 2 | 2 | 2 | 2 | 3 | 3 | 3 |

7 COLUMNS

37 COLUMNS (PARTS HAVING VALUE 1)

7 COLUMNS

FIG.19

| SPRAYING FREQUENCY ADJUSTMENT TABLE a3, b3 (a3 to b3 = 200 μm) | | |
|---|---|---|
| WIDTH POSITION [×100 μm] | 1 | 2 |
| SPRAYING FREQUENCY ADJUSTMENT TABLE a3, b3 | 3 | 3 |

FIG.24

IMAGE CONVERSION BASIS TABLE

| WIDTH POSITION [×100 μm] | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| NAIL SHAPE PATTERN A | 4 | 3 | 3 | 3 | 3 | 3 | 3 | 3 | 3 | 3 | 2 | 2 | 2 | 1 | 1 | 1 | 1 | 1 | 1 | 1 |
| NAIL SHAPE PATTERN B | 4 | 3 | 3 | 2 | 2 | 2 | 2 | 2 | 2 | 2 | 1 | 1 | 1 | 1 | 1 | 1 | 1 | 1 | 1 | 1 |
| NAIL SHAPE PATTERN C | 2 | 2 | 1 | 1 | 1 | 1 | 1 | 1 | 1 | 1 | 1 | 1 | 1 | 1 | 1 | 1 | 1 | 1 | 1 | 1 |

FIG.25

IMAGE CONVERSION ADJUSTMENT TABLE a, b (a to b = 10000 μm)

| WIDTH POSITION [×100 μm] | 1 | 2 | 3 | 4 | 5 | 6 | 7 | 8 | 9 | 10 | 11 | 12 | 13 | 14 | 15 | 16 | 17 | 18 | 19 | 20 | ··· | 80 | 81 | 82 | 83 | 84 | 85 | 86 | 87 | 88 | 89 | 90 | 91 | 92 | 93 | 94 | 95 | 96 | 97 | 98 | 99 | 100 |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| IMAGE CONVERSION ADJUSTMENT TABLE a, b | d1 | d2 | d3 | d4 | d5 | d6 | d7 | d8 | d9 | d10 | d11 | d12 | d13 | d14 | d15 | d16 | d17 | d18 | d19 | d20 | ··· | d80 | d81 | d82 | d83 | d84 | d85 | d86 | d87 | d88 | d89 | d90 | d91 | d92 | d93 | d94 | d95 | d96 | d97 | d98 | d99 | d100 |

FIG.26

IMAGE CONVERSION ADJUSTMENT TABLE a, b (a to b = 10000 μm)

| WIDTH POSITION [× 100 μm] | 1 | 2 | 3 | 4 | 5 | 6 | 7 | 8 | 9 | 10 | 11 | 12 | 13 | 14 | 15 | 16 | 17 | 18 | 19 | 20 | ··· | 80 | 81 | 82 | 83 | 84 | 85 | 86 | 87 | 88 | 89 | 90 | 91 | 92 | 93 | 94 | 95 | 96 | 97 | 98 | 99 | 100 |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| IMAGE CONVERSION ADJUSTMENT TABLE a, b | 4 | 3 | 3 | 3 | 3 | 3 | 3 | 3 | 3 | 2 | 2 | 2 | 2 | 1 | 1 | 1 | 1 | 1 | 1 | 1 | ··· | 1 | 1 | 1 | 1 | 1 | 1 | 1 | 1 | 2 | 2 | 2 | 2 | 3 | 3 | 3 | 3 | 3 | 3 | 3 | 3 | 4 |

FIG.27

| IMAGE CONVERSION ADJUSTMENT TABLE a, b (a to b = 5000 μm) | | | | | | | | | | | | | | | | | | | | | | |
|---|---|---|---|---|---|---|---|---|---|---|---|---|---|---|---|---|---|---|---|---|---|---|
| WIDTH POSITION [×100 μm] | 1 | 2 | 3 | 4 | 5 | 6 | 7 | 8 | 9 | 10 | ··· | 40 | 41 | 42 | 43 | 44 | 45 | 46 | 47 | 48 | 49 | 50 |
| IMAGE CONVERSION ADJUSTMENT TABLE a, b | 2 | 2 | 2 | 1 | 1 | 1 | 1 | 1 | 1 | 1 | ··· | 1 | 1 | 1 | 1 | 1 | 1 | 1 | 1 | 2 | 2 | 2 |

PRINT APPARATUS AND PRINT CONTROL METHOD

CROSS-REFERENCE TO RELATED APPLICATIONS

This application is based upon and claims the benefit of priority from the prior Japanese Patent Application No. 2011-100438, filed Apr. 28, 2011, the entire contents of which are incorporated herein by reference.

BACKGROUND OF THE INVENTION

1. Field of the Invention

The present invention relates to a print apparatus and a print control method of the print apparatus, and more particularly, to a print apparatus to perform printing on a print target surface of a print target subject having a curved shape, and a print control method thereof.

2. Description of the Related Art

Conventionally, there is known an ink jet print apparatus which performs printing to a target subject by spraying ink from a recording head.

In case of the ink jet print apparatus, printing is generally performed while moving the recording head in the horizontal direction above the print target subject.

However, there is a case where the print target surface of the print target subject is not a flat surface but is roundly curved as a whole wherein both right and left edge parts are lower and the center part is higher when seen from one end side as in a human nail, for example. When printing is performed on such print target surface of the print target subject by moving the recording head in the horizontal direction, printing density varies in parts of slanted surface according to the slanting angles thereof and stretching, deforming and the like occur in the printed image (design).

Therefore, in a nail art apparatus to perform printing on human nails, there is suggested a configuration including a contour recognition unit which recognizes a contour of a nail, a concavo-convex recognition unit which recognizes convexes and concaves on the nail and a three-dimensional display unit which three-dimensionally displays the contour/shape of the recognized nail, and the contour/shape of the nail which is the print target subject taking into account the convexes and concaves thereof is accurately recognized to obtain the three-dimensional data of the nail and printing is performed by condensing the ink according to the slanting angles in the curved parts as described in JP 3016147, for example.

However, in the above configuration, the device for strictly and accurately measuring the shape of the print target subject such as nails is large in size.

Further, because a device for carrying out arithmetic processing and digitalizing of the information obtained by a camera or the like is needed, the cost for the apparatus is igh.

Furthermore, because a longer processing time period is needed for the measuring and the arithmetic processing, the time required for the printing processing is long, causing inconveniences.

SUMMARY OF THE INVENTION

The present invention has an advantage of providing a print apparatus for performing printing on a print target surface of a print target subject having a curved print target surface such as human nails and the print control method thereof by which the time required for the printing process when performing printing on the print target surface can be shortened, occurrence of varying in printing density and stretching and deformation in design can be controlled and high quality printing can be performed to the print target surface.

In order to obtain the above advantages, a print apparatus of the present invention which performs printing for a print target surface of a print target subject includes a selection unit which categorizes a curve-shape of the print target surface into one specific shape pattern among a plurality of shape patterns whose degrees of curving are different from each other, where a center part of the print target surface along a first direction is raised higher than edge parts of the print target surface along the first direction, a print unit which has a recording head that applies ink on the print target surface and a control unit which controls the print unit to set an ink amount to be applied at the edge parts of the print target surface to a predetermined amount which is set corresponding to the specific shape pattern.

Further, in order to obtain the above advantages, a print control method of a print apparatus of the present invention which performs printing for a print target surface of a print target subject includes categorizing a curve-shape of a print target surface into one specific shape pattern among a plurality of shape patterns whose degrees of curving are different from each other, a center part of the print target surface along a first direction is raised higher than edge parts of the print target surface along the first direction, and setting an ink amount to be applied at the edge parts of the print target surface to predetermined amount which is set corresponding to the specific shape pattern by controlling a print unit which has a recording head that applies ink on the print target surface.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 14 is a diagram showing an example of a spraying frequency basis table as a pitch adjustment basis table;

FIG. 16 is a diagram showing an example of a spraying frequency adjustment table when the width size of a line is 10000 μm;

FIG. 17 is a diagram showing an example of a spraying frequency adjustment table when the width size of a line is 8000 μm;

FIG. 18 is a diagram showing an example of a spraying frequency adjustment table when the width size of a line is 5000 μm;

FIG. 19 is a diagram showing an example of a spraying frequency adjustment table when the width size of a line is 200 μm;

FIG. 24 is a diagram showing an example of an image conversion basis table as a pitch adjustment basis table;

FIG. 25 is a diagram showing an example of an image conversion adjustment table when the length of a reference line is 10000 μm;

FIG. 26 is a diagram showing an example of an image conversion adjustment table when the length of a reference line is 10000 μm;

FIG. 27 is a diagram showing an example of an image conversion adjustment table when the length of a line is 5000 μm;

DESCRIPTION OF THE PREFERRED EMBODIMENTS

Hereinafter, the print apparatus and the print control method according to the present invention will be described in detail by showing their embodiments.

First Embodiment

First, the first embodiment of the print apparatus according to the present invention will be described with reference to the drawings.

Here, the print apparatus of the present invention is a print apparatus to perform printing to a print target subject including a print target surface having a curved shape. This print apparatus includes a recording head for performing printing on a print target surface by spraying ink droplets.

This print apparatus performs printing on a print target surface having a curved shape following the convex shape of the print target subject, where the distance between the ink spraying surface of the recording head and the print target surface in the ink spraying direction is short at the center part of the print target surface in its width direction and the distance becomes longer as approaching the edge parts of the print target surface in its width direction.

By carrying out printing by the print apparatus of this embodiment, high quality printing can be performed all the way to the edge parts of the print target surface in its width direction on a print target subject which is curved in a convex shape rounded overall where the right and left edge parts in its width direction are lower and the center part in its width direction is arised higher like human nail portions, for example, the print target surface of the print target subject not being flat from edge to edge in the width direction of the print target surface.

In the following embodiment, description will be given for a case where the print apparatus is applied in a nail print apparatus which performs printing to nail portions of human fingers. However, the print apparatus of this embodiment is not limited to be used in the nail print apparatus. The print apparatus of this embodiment can be widely applied as a print apparatus which performs printing to an arbitrary curved target subject in which the print target surface thereof includes curve-shape.

Figure 1:
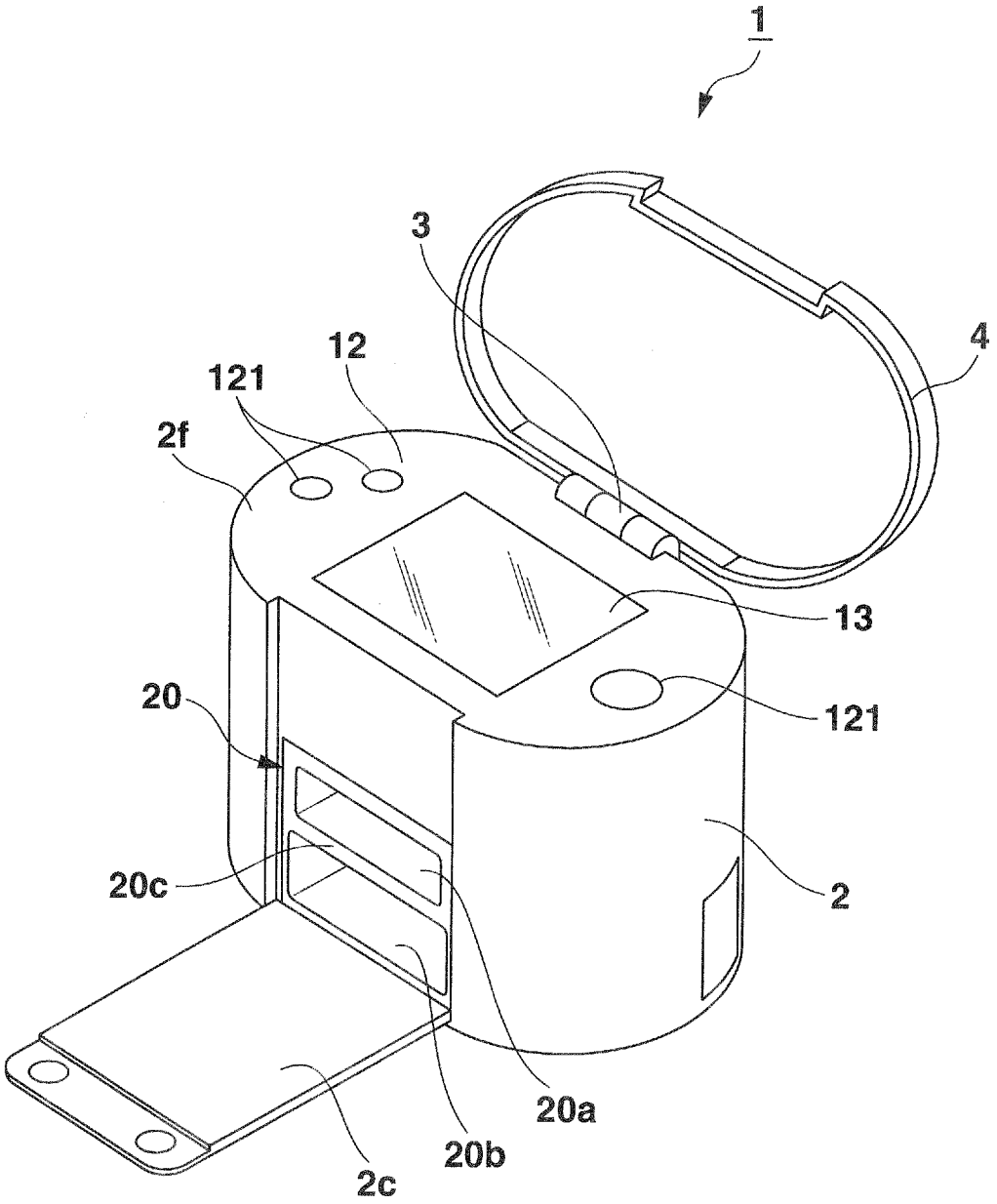
FIG. 1 is a schematic diagram illustrating an outer appearance of a nail print apparatus as a first embodiment of the print apparatus according to the present invention.

FIG. 1 is a schematic diagram illustrating an outer appearance of the nail print apparatus of this embodiment.

Figure 2:
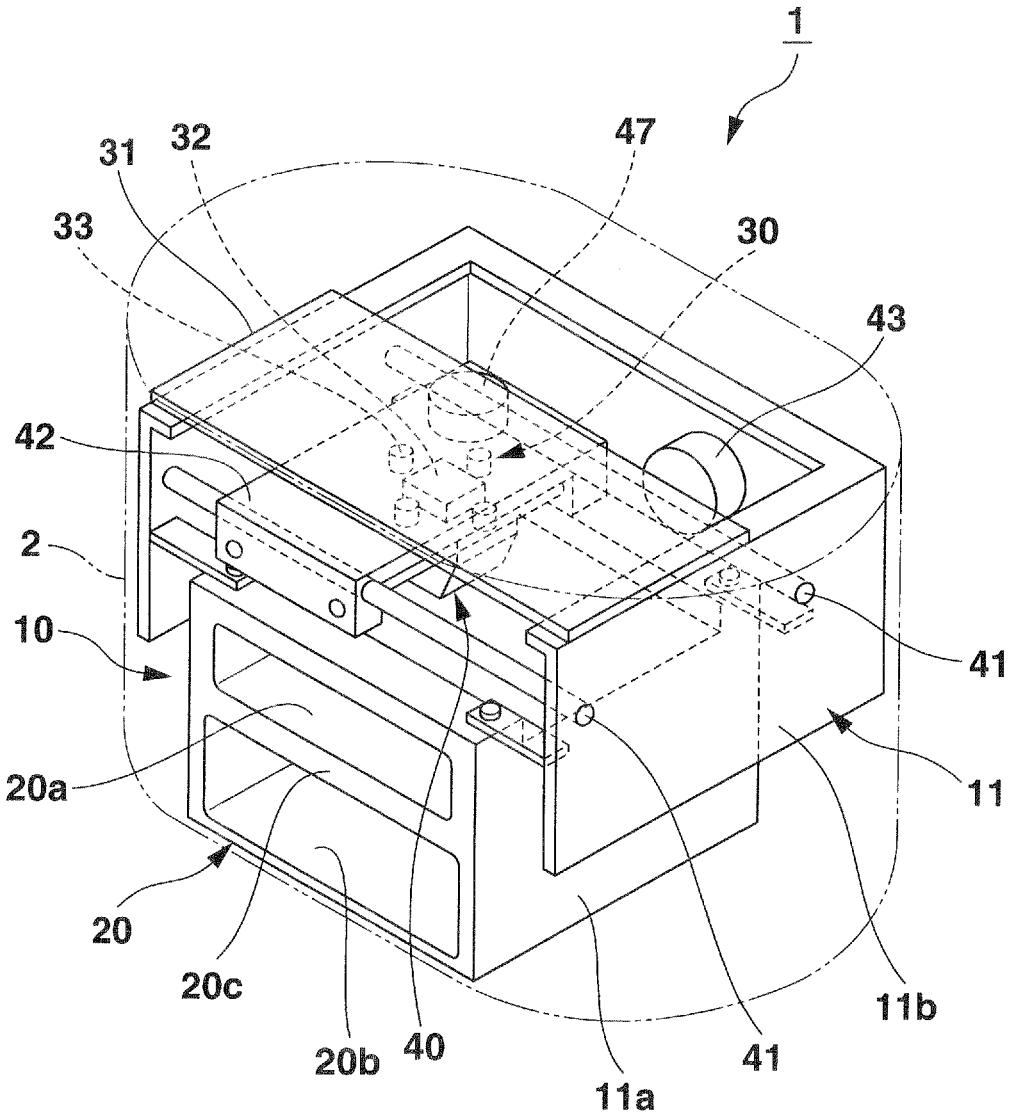
FIG. 2 is a schematic diagram of an inner configuration of the nail print apparatus in the first embodiment.

FIG. 2 is a schematic diagram illustrating an inner configuration of the nail print apparatus of this embodiment.

Figure 3:
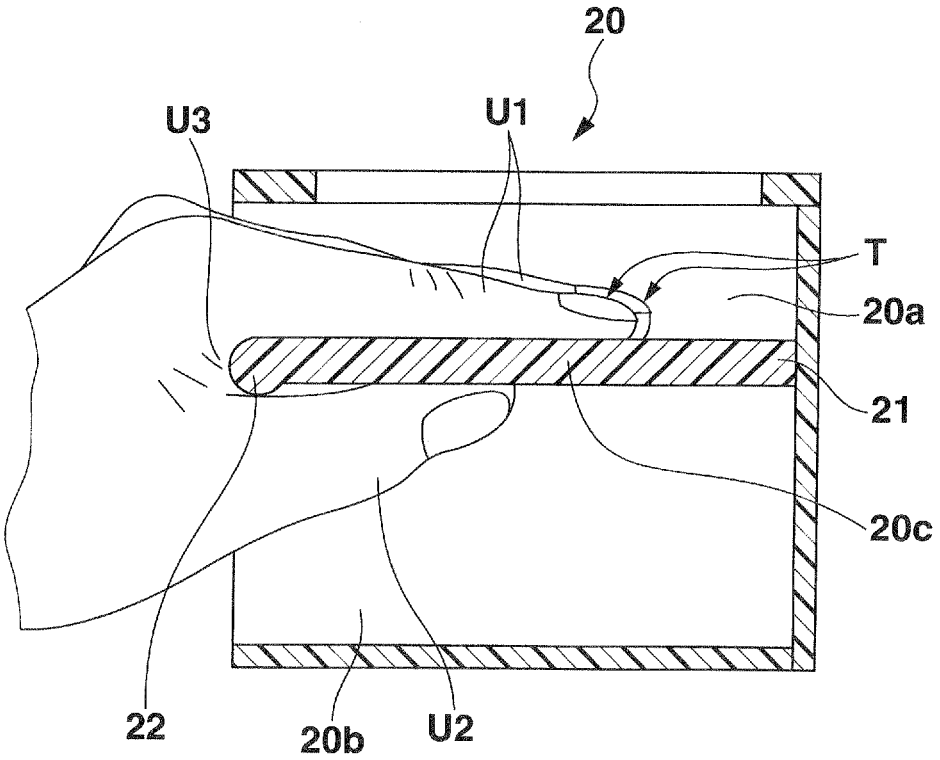
FIG. 3 is a cross-sectional diagram illustrating a printing finger fixation unit of the nail print apparatus in the first embodiment which shows the fixed condition of printing fingers when fingers from index finger to little finger are inserted in the printing finger insertion unit as printing fingers.

FIG. 3 is a cross-sectional view illustrating a printing finger fixation unit in the nail print apparatus of this embodiment where the fixed condition when the fingers from index finger to little finger are inserted in the printing finger insertion unit as the printing fingers.

As shown in FIG. 1, the nail print apparatus 1 is provided with a case main body 2 and a cover 4. The case main body 2 and the cover 4 are joined to each other via a hinge 3 provided at the back end of the upper surface of the case main body 2.

The case main body 2 is formed in an oblong shape, for example, when seen planarly.

An open-close plate 2*c* is provided on the front side of the case main body 2 so as to flip up and down with respect to the case main body 2.

The open-close plate 2*c* is connected with the case main body 2 via a hinge provided at the lower end of the front side of the case main body 2. The open-close plate 2*c* is for opening and closing the front side of the case main body 2.

An operation unit 12 is provided on a top board 2*f* of the case main body 2. A display unit 13 is provided at the center part of the top board 2*f*.

Here, shapes and configurations of the case main body 2 and the cover 4 are not limited to the examples described above.

In the case main body 2, the apparatus main body 10 of the nail print apparatus 1 is housed.

The apparatus main body 10 includes a printing finger fixation unit 20 which constitutes the unit for fixing the printing fingers as shown in FIG. 2, a photographing unit 30, a print unit 40 and a control devise 50 (see FIG. 8) which constitutes the control unit.

The printing finger fixation unit 20, the photographing unit 30, the print unit 40 and the control device 50 are provided in the machine casing 11.

The machine casing 11 is constituted of a lower machine casing 11*a* and an upper machine casing 11*b*.

The lower machine casing 11*a* is formed in a box shape and is set inside the case main body 2 at the lower part thereof.

The upper machine casing 11*b* is set below the lower machine casing 11*a* and inside the case main body 2 at the upper part thereof.

The printing finger fixation unit 20 is provided in the lower machine casing 11*a* in the machine casing 11.

The printing finger fixation unit 20 is constituted of the printing finger insertion unit 20*a*, the non-printing finger insertion unit 20*b* and the holding unit 20*c* which are provided in the lower machine casing 11*a*.

As shown in FIG. 3, the printing finger insertion unit 20*a* is a finger insertion unit for inserting a finger (hereinafter, called "printing finger") U1 corresponding to the nail portion T to which printing is to be performed.

The bottom (printing finger placing surface) of the printing finger insertion unit 20*a* functions as a finger placement unit for placing the printing finger U1.

Photographing and printing of the printing finger U1 is carried out in a state where the printing finger U1 is placed on the printing finger placing surface of the printing finger insertion unit 20*a* as a finger placement unit.

As shown in FIG. 3, the non-printing finger insertion unit 20*b* is a finger insertion unit for inserting a finger (hereinafter, called "non-printing finger") U2 other than the printing finger.

The holding unit 20*c* is a part that can be sandwiched by the printing fingers U1 inserted in the printing finger insertion unit 20*a* and the non-printing finger U2 inserted in the non-printing finger insertion unit 20*b*.

In this embodiment, the holding unit 20*c* is constituted of the partition 21 which separates the printing finger insertion unit 20*a* and the non-printing finger insertion unit 20*b*.

The upper surface of the partition 21 is formed into a flat surface, for example, and constitutes the printing finger placement surface.

A bulged portion 22 is formed at the end of the partition 21 on the finger inserting side.

The bulged portion 22 is a part where the base U3 of the printing fingers U1 and non-printing finger U2 contacts when the printing fingers U1 are deeply inserted in the printing finger insertion unit 20*a* and the non-printing finger U2 is deeply inserted in the non-printing finger insertion unit 20*b*.

The bulged portion 22 is formed in a shape so that the partition 21 (holding unit 20*c*) can be firmly sandwiched by the printing fingers U1 and the non-printing finger U2 in a state where the entire balls of the printing fingers U1 contacting the printing finger placing surface. Therefore, the bulged portion 22 is formed in a shape where the cross-section of the bulges portion 22 in the finger inserting direction bulges downward from the lower surface of the partition 21, and for example, is formed in a shape where the cross-section of the bulged portion 22 in the thickness direction of the partition 21 is formed in an arc shape.

Here, the cross-sectional shape of the bulged portion 22 is not limited to the arc shape, and for example, the cross-section can be an oval shape or a non-circle shape such as polygonal shapes.

For example, when the four fingers (index finger, middle finger, ring finger and little finger) other than the left thumb are the printing fingers U1, a user inserts the four printing fingers U1 in the printing finger insertion unit 20*a* and inserts the thumb which is the non-printing finger U2 in the non-printing finger insertion unit 20*b* as shown in FIG. 3.

In this case, a use can sandwich and hold the holding unit 20*c* with the printing fingers U1 which are inserted in the printing finger insertion unit 20*a* and the non-printing finger U2 which is inserted in the non-printing finger insertion unit 20*b*. Thereby, the printing fingers U1 are fixed on the holding unit 20*c*.

On the other hand, in a case where the thumb is the printing finger U1, the thumb (printing finger U1) is inserted in the printing finger insertion unit 20*a* and the four fingers (non-printing fingers U2) other than the thumb are inserted in the non-printing finger insertion unit 20*b*. In this case, a user can also sandwich and hold the holding unit 20*c* with the printing finger U1 and the non-printing fingers U2 and the printing finger U1 is fixed on the holding unit 20*c*.

Figure 4:
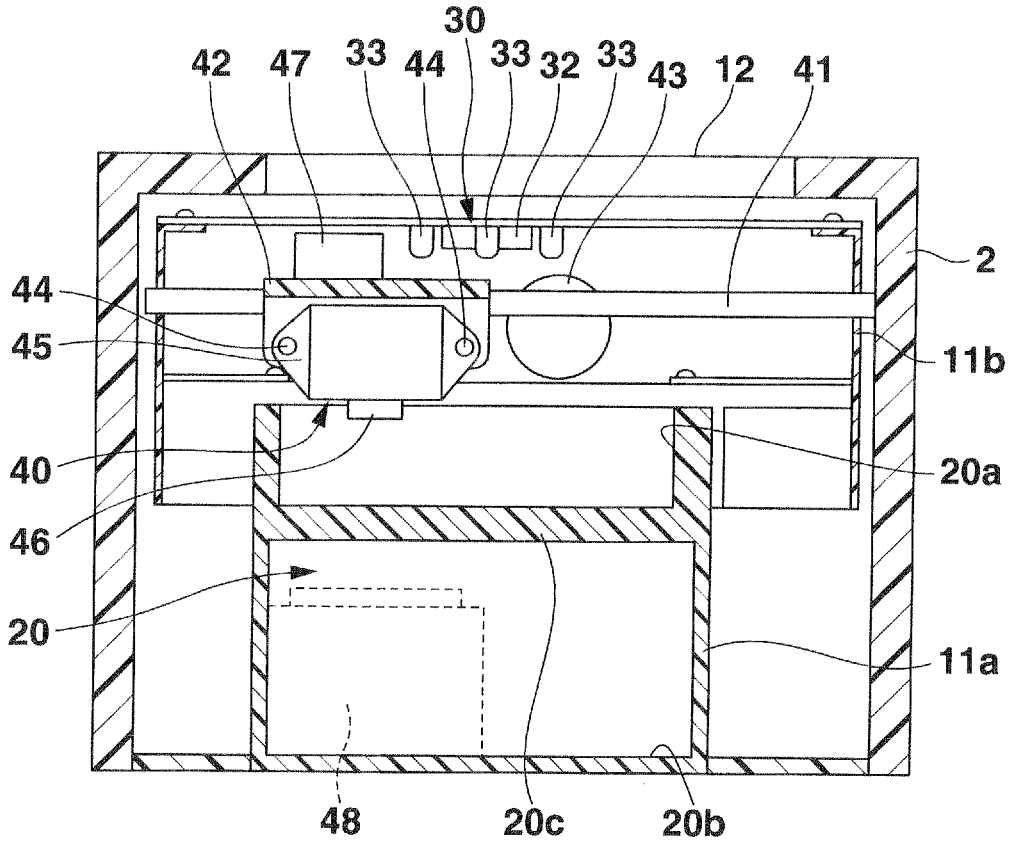
FIG. 4 is a cross-sectional diagram illustrating the front view of the nail print apparatus in the first embodiment.

FIG. 4 is a cross-sectional view of the front of the nail print apparatus of this embodiment.

Figure 5:
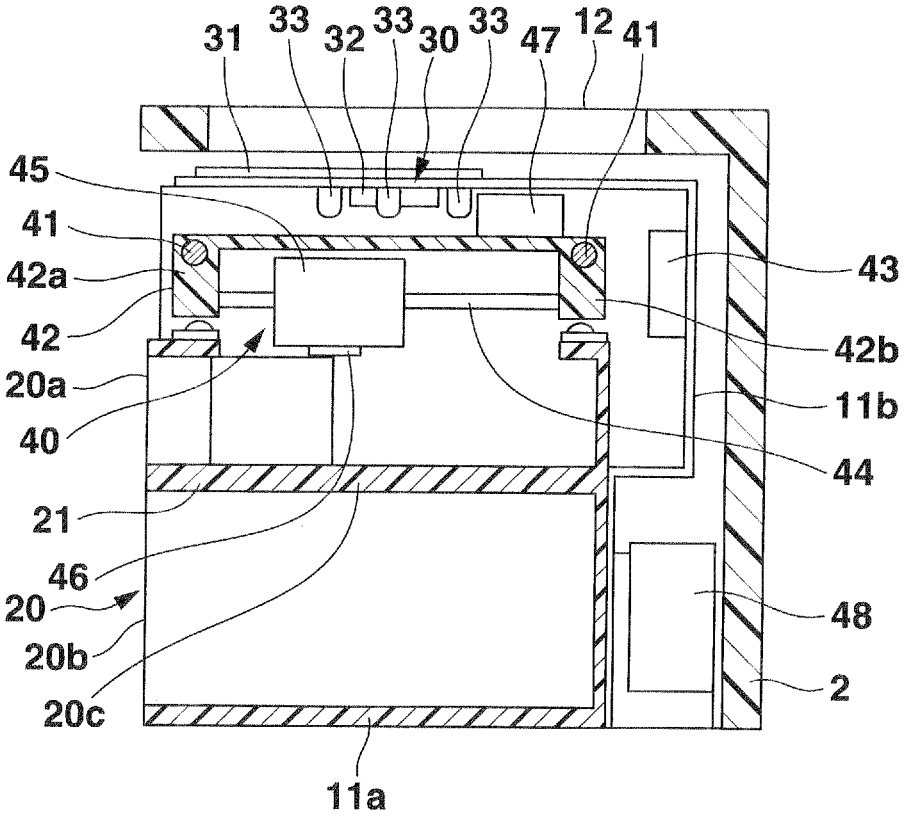
FIG. 5 is a cross-sectional diagram illustrating a side view of the nail print apparatus in the first embodiment.

FIG. 5 is a cross-sectional view of a side of the nail print apparatus of this embodiment.

Figure 6:
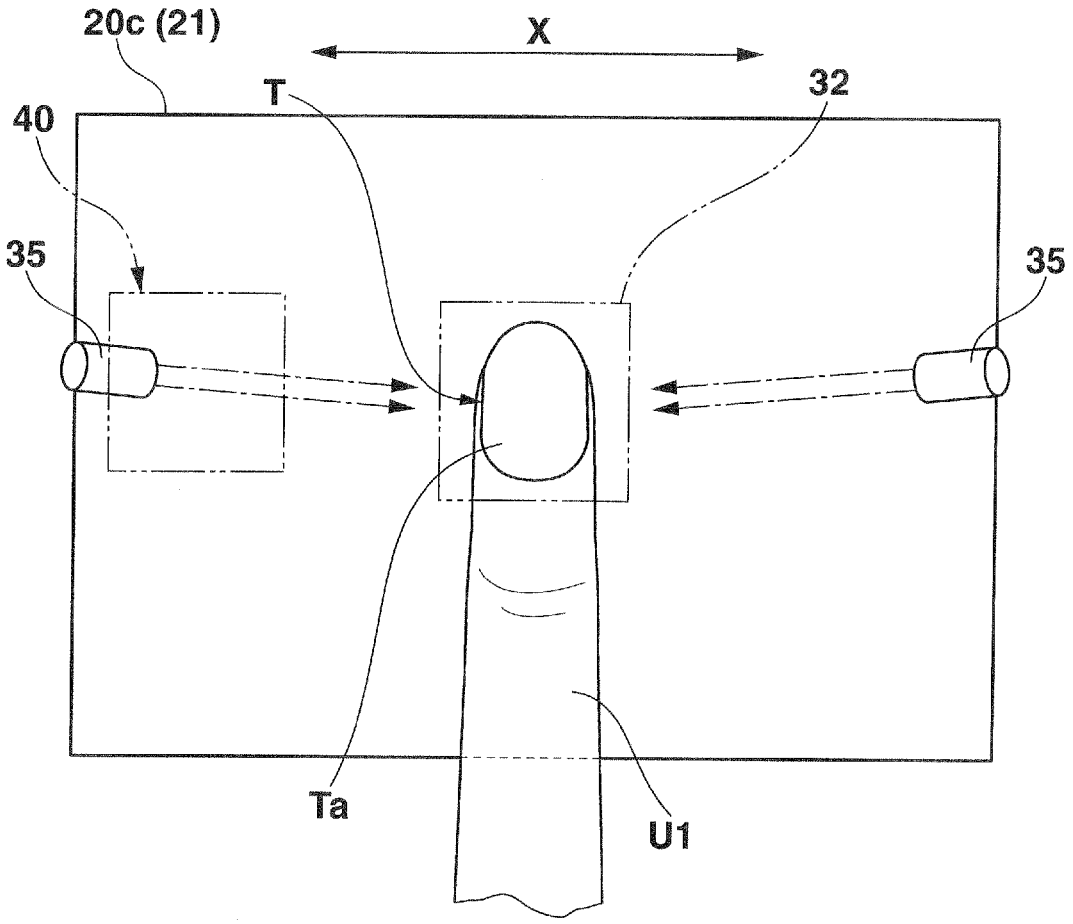
FIG. 6 is a plane view for explaining a unit for measuring the height size of a nail portion.

FIG. 6 is a main part plane view when an example of the unit for measuring the height size of a nail portion of this embodiment is seen from above.

Figure 7:
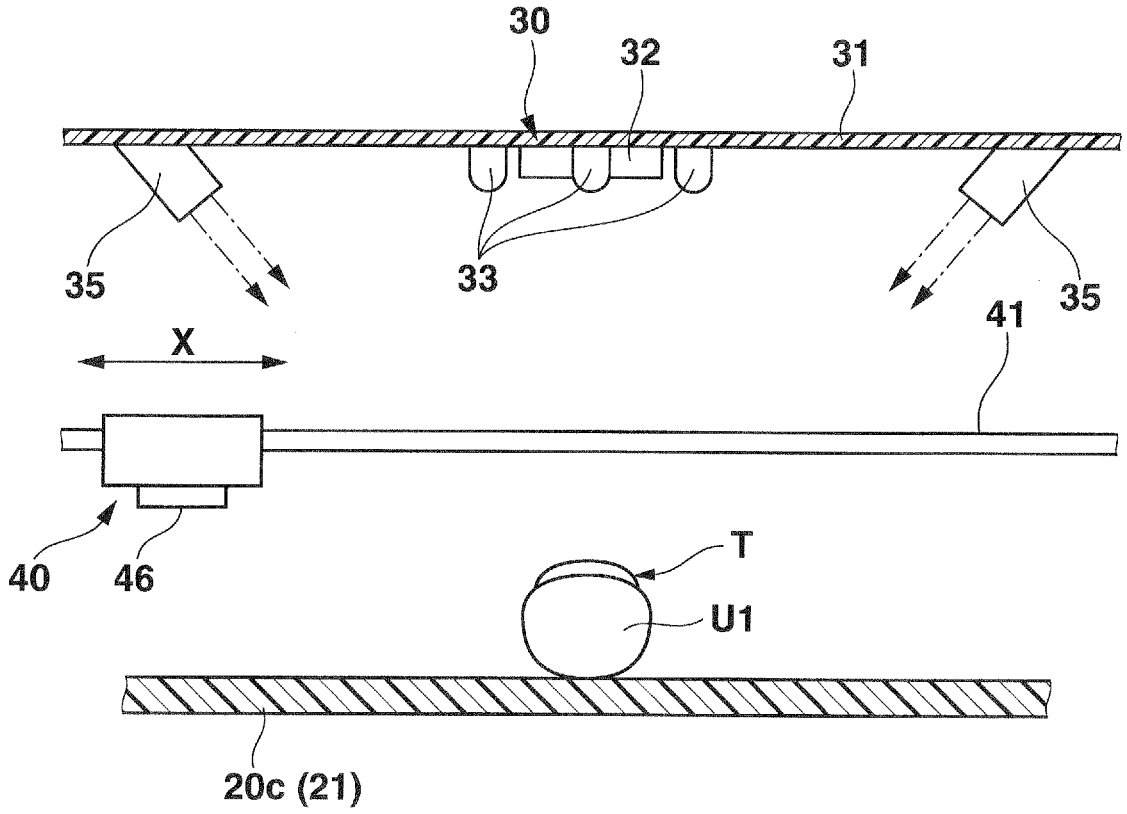
FIG. 7 is a main part cross-sectional diagram when the unit for measuring the height size of a nail portion is seen from the front.

FIG. 7 is a main part cross-sectional view when the unit for measuring the height size of a nail portion shown in FIG. 6 is seen from front.

Figure 8:
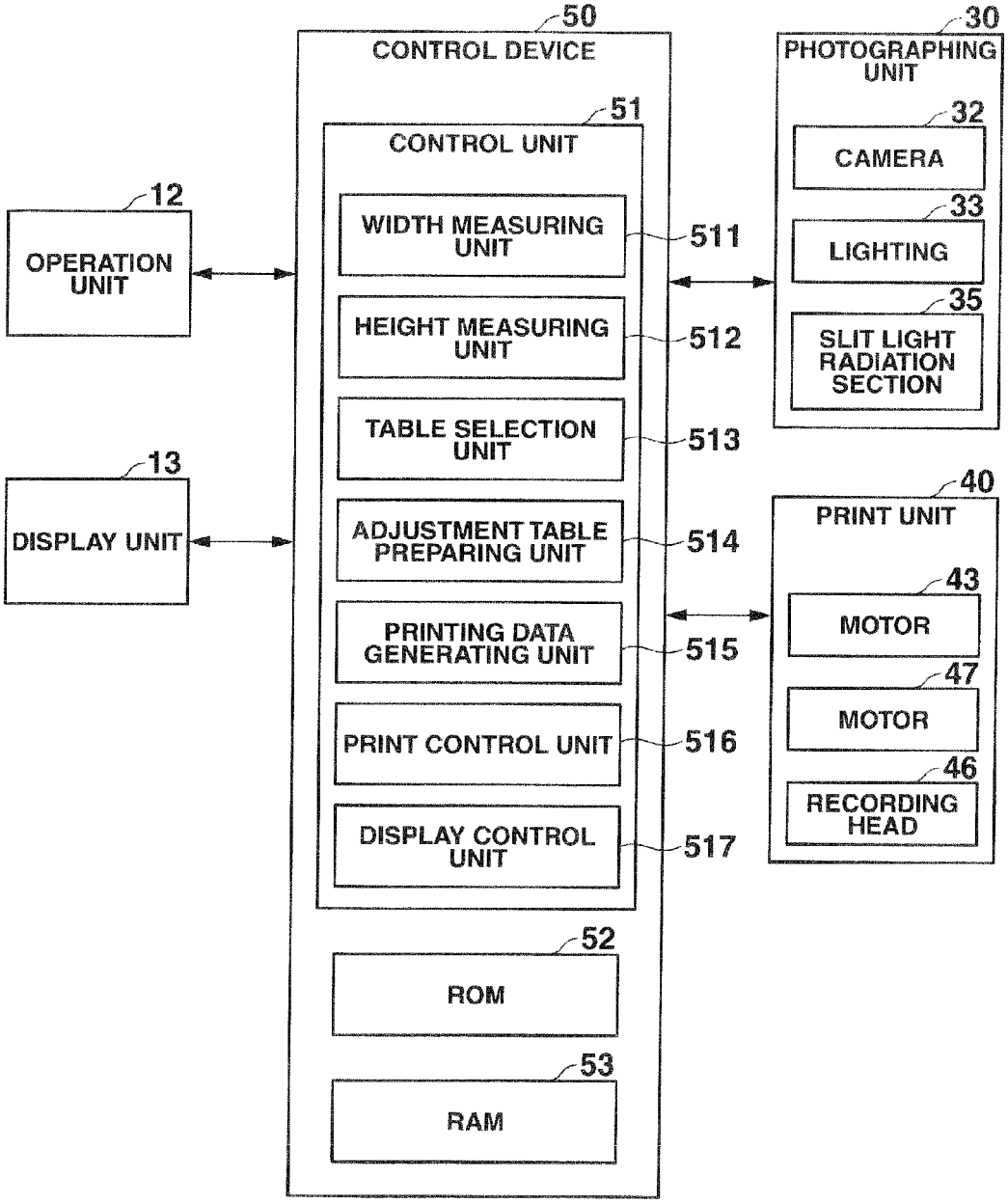
FIG. 8 is a main part block diagram illustrating a control configuration of the nail print apparatus of the first embodiment.

FIG. 8 is a main part block diagram illustrating the control configuration of the nail print apparatus of this embodiment.

As shown in FIGS. 4 and 5, the photographing unit 30 is provided in the upper machine casing 11*b* which is in the machine casing 11.

The photographing unit 30 includes a camera 32, lightings 33 and slit light radiation sections 35.

That is, the camera 32 in which a driver is embedded, the camera 32 having about 2,000,000 pixels or more, is disposed at the center part of the lower surface of the substrate 31 which is disposed at the upper machine casing 11*b*.

The lightings 33, such as while LED, are disposed at the substrate 31 so as to surround the camera 32.

The photographing unit 30 lights the printing fingers U1 placed in the printing finger insertion unit 20*a* which is the finger placement unit by the lightings 22. The camera 32 photographs the surface (print target surface) of the nail portion T (print target subject) of each printing finger U1. Here, the surface of the nail portion T which is the print target surface is the nail region Ta. The camera 32 functions as a photographing unit to obtain a nail region image which is a print target region image.

The photographing unit 30 is connected to the control unit 51 of the after-mentioned control device 50 and is controlled by the control unit 51.

The nail print apparatus 1 includes a unit for measuring the height size of the nail portion T in the ink spraying direction from the recording head 46 of the print unit 40.

The unit for measuring the height size of the nail portion T in this embodiment is, for example, configured by using the slit light radiation sections 35, the photographing unit 30 and the control device 50 as shown in FIGS. 6 and 7.

The slit light radiation sections 35 are light sources which emit slit lights (narrow light like a line) and are provided as independent lightings separately from the lightings 33.

The slit light radiation sections 35 are provided so as to irradiate the nail portion T of the printing finger U1 with slit lights from obliquely above directions.

By radiating the slit lights from the slit light radiation sections 35 to the nail portion T, slit images SL appear on the surface of the nail portion T.

The slit images SL are photographed by the camera 32 of the photographing unit 30 along with the nail portion T and the nail region image including the slit images SL is obtained from the photographed image.

The obtained nail region image including the slit images SL is transmitted to the after-mentioned height measuring unit 512 of the control device 50 and the nail region image is analyzed in the height measuring unit 512 to calculate the height of the nail portion t.

In such way, in this embodiment, the slit light radiation sections 35, the photographing unit 30 and the height measuring unit 512 of the control device 50 constitute the height measuring unit (nail shape obtaining unit) which measures the size of the nail portion T in its height direction.

Here, the above described unit for measuring the size of the nail portion T in its height direction is only an example and may have other configurations. For example, the configuration may be such that the size of the nail portion T in its height direction is calculated based on the analysis of the nail region image photographed by the camera 32 without using the slit light radiation sections 35. Or the configuration may be such that the size of the nail portion T in its height direction is detected by a height sensor by providing an electric capacity type height sensor, for example, at the position facing the nail portion T.

The print unit 40 sprays ink droplets to the nail region Ta (see FIG. 6, for example) on the surface of the nail portion T, which is the print target surface, to perform printing of colors, patterns and the like on the nail region Ta. The print unit 40 is provided mainly in the upper machine casing 11*b*.

As shown in FIGS. 4 and 5, two guide rods 41 are bridged horizontally in right and left direction, being parallel to each other, between the two side boards of the upper machine casing 11*b*. A main carriage 42 is attached to the guide rods 41 so as to slide along the guide rods 41.

As shown in FIG. 5, two guide rods 44 are bridged between the front wall 42*a* and the back wall 42*b* of the main carriage 42 along the direction orthogonal to the guide rods 41, the guide rods 44 being parallel to each other. A secondary carriage 45 is attached to the guide rods 44 so as to slide along the guide rods 44. A print head 46 is mounted on the secondary carriage 45 at the center part in the lower surface thereof.

In this embodiment, the recording head 46 is an ink-jet type recording head which makes ink be in the form of micro droplets and intermittently sprays ink droplets to perform printing by landing the ink droplets on the print target surface.

Here, the recording method of the recording head 46 is not limited to the ink-jet method. The recording head 46 may perform printing with other methods.

The main carriage 42 is connected to the motor 43 via a power transmitting unit (not shown in the drawings), and the main carriage 42 moves in right and left direction along the guide rods 41 by the forward-reverse rotation of the motor 43.

The secondary carriage 45 is connected to the motor 47 via a power transmitting unit (not shown in the drawings), and the secondary carriage 45 moves in front and back direction along the guide rods 44 by the forward-reverse rotation of the motor 47. The moving direction in right and left of the main carriage 42 along the guide rods 41 is in the direction along the width direction of the nail region Ta which is the print target surface in the nail portion T of a printing finger U1 inserted in the printing finger insertion unit 20*a*.

An ink cartridge 48 for supplying ink to the recording head 46 is provided at the lower machine casing 11*a*.

The ink cartridge 48 is connected with the recording head 46 via an ink supply tube (not shown in the drawings), and the ink cartridge 48 arbitrarily supplies ink to the recording head 46 via the ink supplying tube.

Here, the configuration may be such that the ink cartridge is mounted on the recording head 46.

When performing printing, the recording head 46 performs printing by intermittently spraying ink droplets to the print target surface while being moved in right and left direction (horizontal direction) by the main carriage 42.

The recording head 46 causes the sprayed ink droplets land on the print target surface and forms a dot or multiple dots with a plurality of ink droplets on the print target surface. In such way, a dot pattern in which multiple dots each having a predetermined amount of ink are arranged is formed. Here, printing pitch is defined as a moving distance of the recording head 46 in horizontal direction from the position where the printer head 46 formed one dot on the print target surface to the position where the printer head 46 forms the next dot on the print target surface.

Therefore, the printing pitch corresponds to the time interval between spraying of ink droplets performed by the recording head 46. Further, when the recording head 46 is moving with respect to the print target surface at a constant speed, printing pitch corresponds to the number of times of spraying per unit time of the ink droplets which are intermittently sprayed from the recording head 46.

The print unit 40 includes the guide rods 41, the main carriage 42, the motor 43, the guide rods 44, the secondary carriage 45, the recording head 46, the motor 47, the ink cartridge 48 and the like.

The motor 43, recording head 46 and motor 47 of the print unit 40 are connected to the after-mentioned control unit 51 of the control device 50 and they are controlled by the control unit 51.

The operation unit 12 is an input unit for a user to carry out various types of inputs.

For example, a power switch button to turn on the power of the nail print apparatus 1, a stop switch button to stop the operation and an operation buttons 121 to carry out other various types of inputs are arranged in the operation unit 12.

The display unit 13 is constituted of a liquid crystal display (LCD) or the like, for example.

Here, a touch panel can be integrally formed on the surface of the display unit 13. In such case, various types of inputs can be carried out by touching the surface of the display unit 13 by a stylus pen, a finger tip or the like which are not shown in the drawing.

In the display unit 13, for example, a finger and nail image which is a photographed image of a printing finger U1 and the nail region Ta in the finger and nail image, a nail design image as an image to be printed in the nail region Ta of the printing finger U1, a thumbnail image for design confirmation and such like are to be displayed.

The control device 50 is, for example, provided at the upper machine casing 11*b* and is disposed at the substrate 31.

As shown in FIG. 8, the control device 50 is a computer including a control unit 51 constituted of a CPU (Central Processing Unit) or the like which is not shown in the drawing and a ROM (Read Only Memory) 52, a RAM 53 (Random Access Memory) and the like as storage units.

Here, the storage units are not limited to the ROM 52 and the RAM 53 in the control device 50. Storage units can be provided independently from the control device 50.

In the ROM 52, a plurality of programs are stored. The programs include a nail height measuring program for measuring the size of a nail portion T in its height direction, a nail width measuring program for measuring the size of a nail portion T in its width direction, a table selection program for selecting the best matched table by categorizing the shape of the nail portion T of a user by pattern, a table generation program for generating a pitch adjustment table corresponding to the shape of the nail portion T of a user, a printing data generation program for generating printing data, a print program for performing printing processing and such like, for example.

The control device 50 arbitrarily executes the above programs to control each part in the nail print apparatus 1.

In the ROM 52, an original image data, data for pattern categorization, a pitch adjustment basis table are further stored.

Here, original image data is image data of an image (nail design) to be printed in the nail region Ta on the surface of the nail portion T of the printing finger U1, which is the print target surface.

The ROM 52 functions as an original image data storage unit in which original image data is stored.

Figure 9:
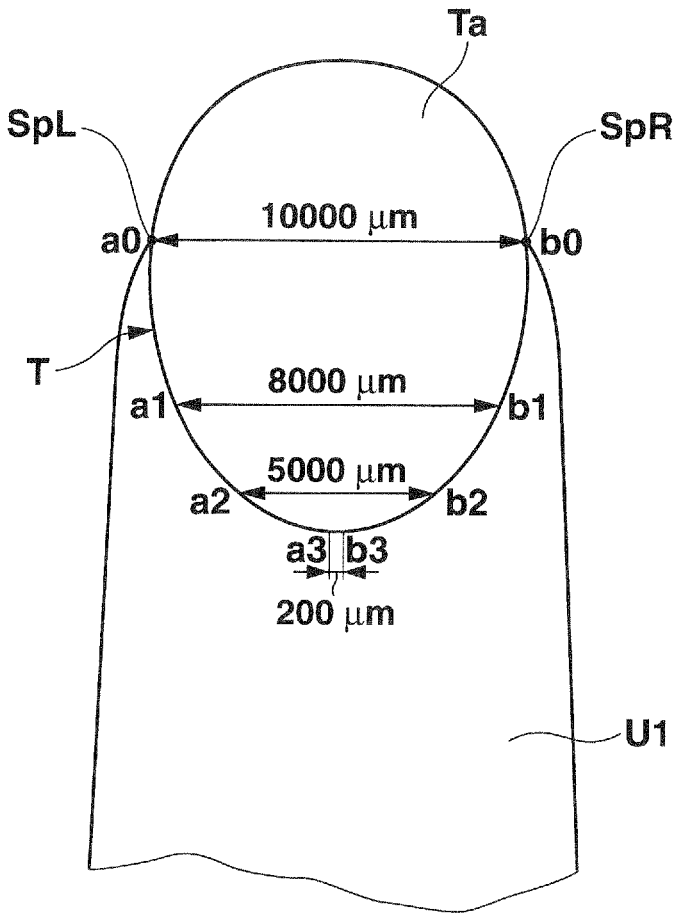
FIG. 9 is an explanatory diagram illustrating an example of a nail region.

FIG. 9 is an explanatory diagram which illustrates an example of a nail region.

Figure 10:
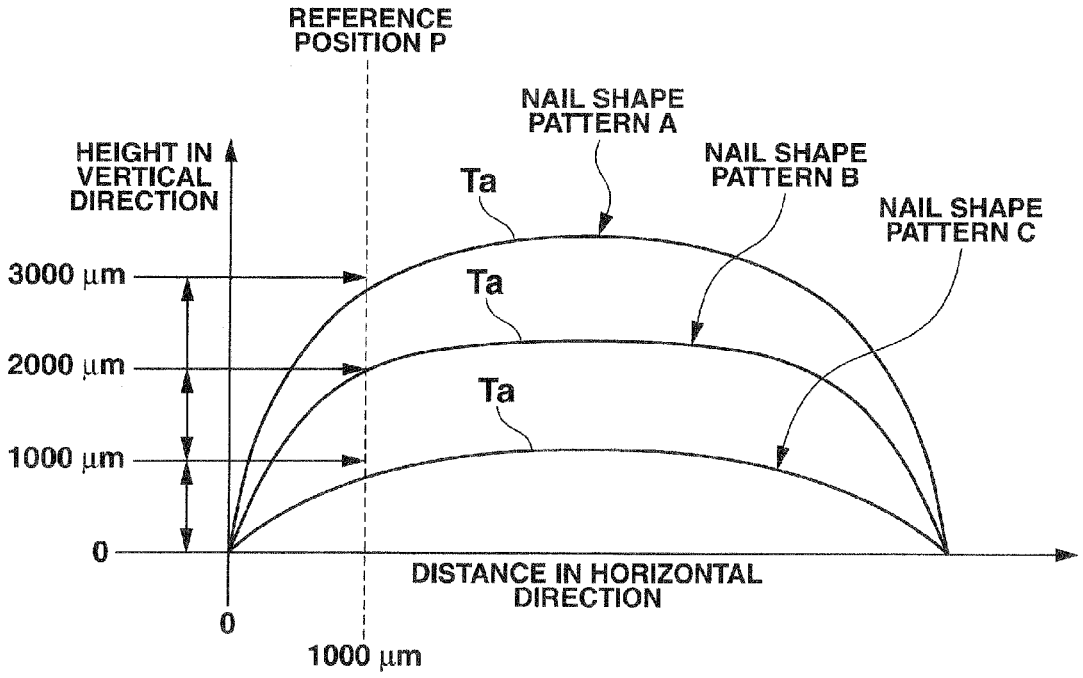
FIG. 10 is a diagram illustrating an example of nail shape patterns into which the nail portion is to be classified by the table selection unit.

FIG. 10 is a diagram showing an example of nail shape patterns in to which the shape of the nail portion T is to be categorized by the table selection unit in this embodiment.

The data for pattern categorization is data required for the after-mentioned table selection unit 51 to categorize the nail portion T which is the print target subject by pattern according to its height size in the ink spraying direction from the recording head 46 of the print unit 40.

In this embodiment, the table selection unit 51 categorizes the curved shape of the nail portion T into one of three nail shape patterns A, B and C, for example, wherein their degrees of curving being different from each other, according to the height sizes at the parts near both sides where the end parts of the nail portion T separates from the skin of nail be of the finger in the curve of the nail portion T along its width direction.

Here, the both side parts where the edge parts of the nail portion T in its width direction separate from the skin of nail bed of the finger are called the stress points Sp. In FIG. 9, the left stress point is indicated as SpL and the right stress point is indicated as SpR.

As shown in FIG. 10, the position set toward the center part for 1000 μm, for example, from one edge of the nail portion T in horizontal direction in the curve-shape formed along the width direction of the nail portion T between the left and right stress points SpL and SpR is indicated as a reference position P. Here, the reference position P is set to a position on the curve-shape between the left and right stress points SpL and SpR. However, the reference position P is not limited to such position. For example, the reference position P may be set to a position on a curve-shape between points near the left and right stress points SpL and SpR.

The data for pattern categorization is the threshold of height size of the curve-shape of the nail portion T at the reference position P in vertical direction from the edge of the nail portion T.

In this embodiment, threshold data of the three nail shape patterns A, B and C are stored in the ROM 52 as the data for pattern categorization.

That is, as shown in FIG. 10, whether the curve-shape of the nail portion T is the nail shape pattern A or not is determined by referring to the threshold whether the height size of the curve-shape of the nail portion T at the reference position P from the edge of the nail portion T is higher than 2000 μm. When the height size is higher than 2000 μm, the curve-shape of the nail portion T is categorized as the nail shape pattern A.

Whether the nail portion T is the nail shape pattern B or not is determined by referring to the threshold whether the height size of the curve-shape of the nail portion T at the reference position P from the edge of the nail portion T is between 1000 μm and 2000 μm. When the height size is within the threshold, the curve-shape of the nail portion T is categorized as the nail shape pattern B.

Whether the curve-shape of the nail portion T is the nail shape pattern C or not is determined by referring to the threshold whether the height size of the curve-shape of the nail portion T at the reference position P from the edge of the nail portion T is smaller than 1000 μm. When the height size is smaller than 1000 μm, the curve-shape of the nail portion T is categorized as the nail shape pattern C.

Here, the position of the reference position P and threshold values are examples and are not limited to the above mentioned values.

The method for setting the threshold for categorizing into nail shape pattern is not limited to the example shown in FIG. 10.

For example, an inclined angle α between the strait line connecting the edges of the curve-shape of the nail portion in its width direction and one edge part of the nail portion T can be measured and threshold can be set for the value of the measured inclined angle α to carry out categorization into nail shape pattern.

Figure 11A:
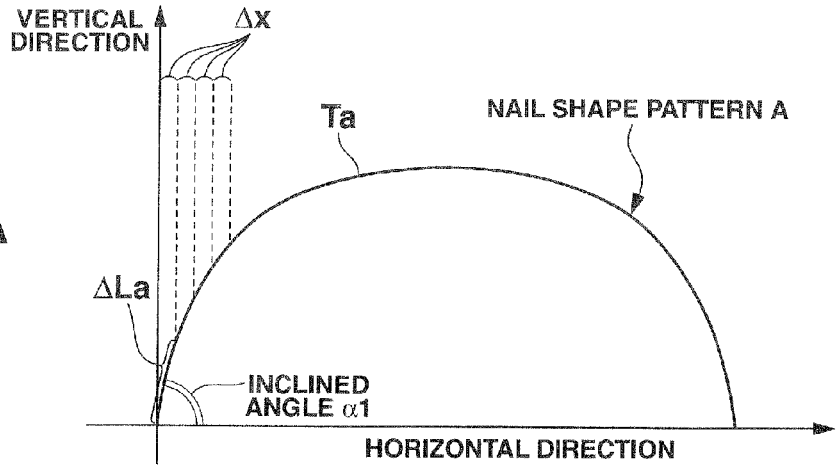
FIG. 11A is a cross-sectional diagram illustrating an example of a slanting angle $\alpha 1$ in the case of nail pattern A.
Figure 11B:
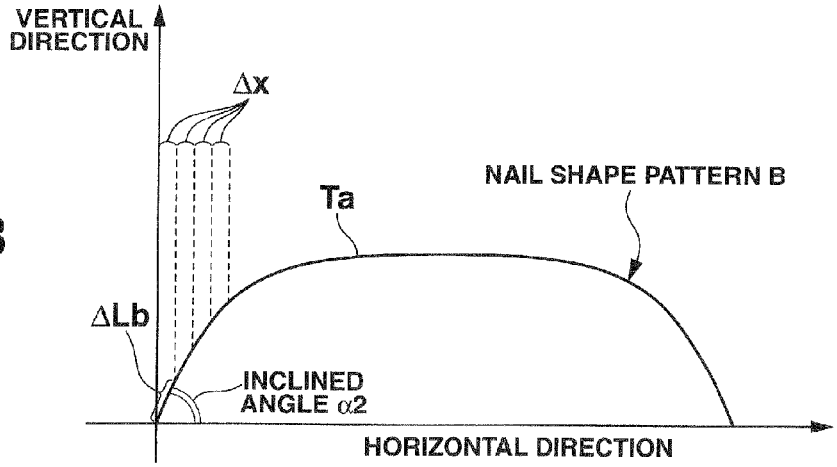
FIG. 11B is a cross-sectional diagram illustrating an example of a slanting angel $\alpha 2$ in the case of nail pattern B.
Figure 11C:
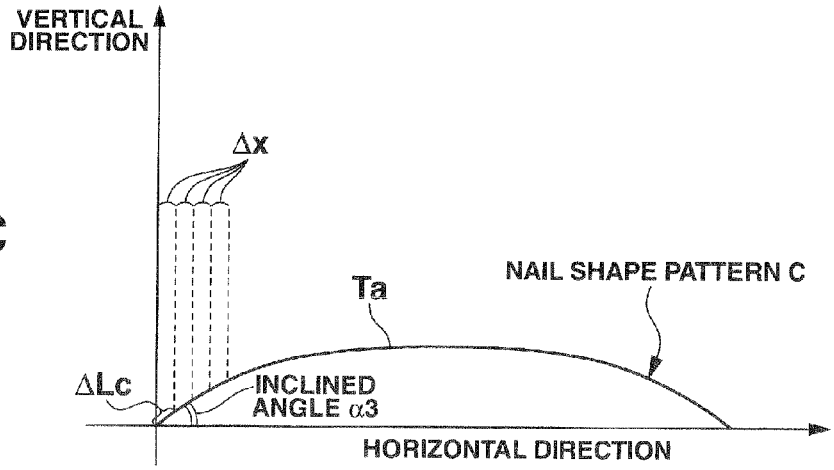
FIG. 11C is a cross-sectional diagram illustrating an example of a slanting angle $\alpha 3$ in the case of nail pattern C.

FIG. 11A is a cross-sectional view illustrating an example of the inclined angle α1 in the case of nail shape pattern A, FIG. 11B is a cross-sectional view illustrating an example of the inclined angle α2 in the case of nail shape pattern B and FIG. 11C is a cross-sectional view illustrating an example of the inclined angle α3 in the case of nail shape pattern C.

In other words, as shown in FIGS. 10 and 11, when the height size of the curve-shape of the nail portion T at the reference position P is large, the inclined angle α at the edge is also large. On the other hand, when the height size of the curve-shape of the nail portion T at the reference position P is small, the inclined angle α at the edge is also small.

For example, in the nail shape pattern A, the inclined angle α1 has a value greater than 60 degrees. In the nail shape pattern B, the inclined angle α2 has a value between 45 degrees and 60 degrees. In the nail shape pattern C, the inclined angle α3 has a value smaller than 45 degrees.

In such way, by defining the value of the inclined angle α as threshold, categorization into nail shape pattern can be carried out similarly to the case where the height of the curve-shape of the nail portion T at the reference position P is defined as threshold.

Here, in this embodiment, the case where a curve-shape of a nail portion is categorized into one of three types of the nail shape patterns A, B and C. However, categorizing into nail shape pattern is not limited to the above example, and categorization can be made into less than three patterns. Alternatively, there may be more nail shape patterns and the shape of a nail portion T may be categorized more specifically.

As shown in FIGS. 11A to 11C, when constant intervals Δx are laid horizontally in the width direction of the curve-shape of a nail portion T, ΔL can be expressed by the formula of $\Delta L=\Delta x/\cos\alpha$ wherein the length of the surface of the nail portion T per Δx is ΔL. At this time, ΔL which is the length of the surface of a nail portion T per Δx becomes longer as the inclined angle α at the edge becomes larger due to the height size of the curve-shape of the nail portion T at the reference position P being larger.

The length of the surface of a nail portion T per Δx in the case of the nail shape pattern A shown in FIG. 11A is indicated as ΔLa. The length of the surface of a nail portion T per Δx in the case of the nail shape pattern B shown in FIG. 11B is indicated as ΔLb. The length of the surface of a nail portion T per Δx in the case of the nail shape pattern C shown in FIG. 11C is indicated as ΔLc. The relation is ΔLa>ΔLb>ΔLc.

Further, as shown in FIGS. 11A to 11C, when the nail portion T has curve-shapes in its width direction and when the center part of the nail portion T in its width direction is approximately flat, the values of ΔLa to ΔLc be close to the value of Δx as approaching the center part of the nail portion T in its width direction.

Figure 12A:
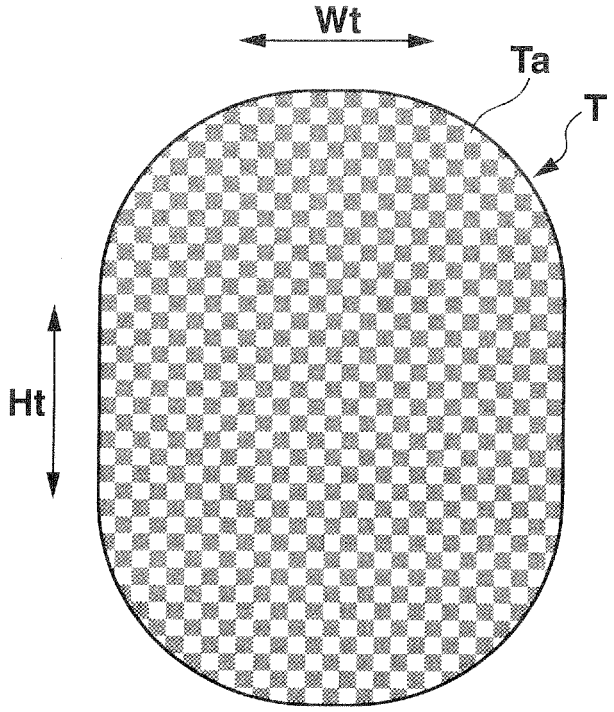
FIG. 12A is a plane view showing an example of a nail region to which a lattice pattern nail design is applied.
Figure 12B:
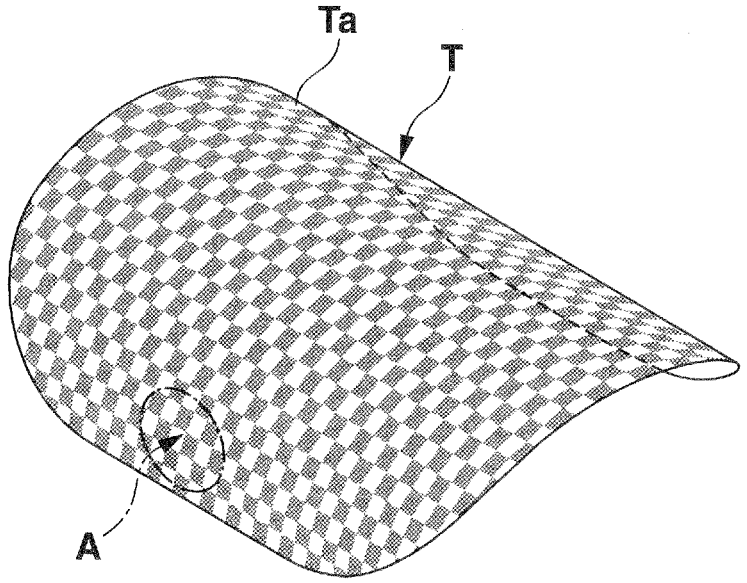
FIG. 12B is a schematic view of the nail region shown in FIG. 12A.

FIG. 12A is a plane view of a nail region in which a lattice pattern nail design is printed when the nail region is seen from above, and FIG. 12B is a schematic view of the nail region shown in FIG. 12A.

Figure 13:
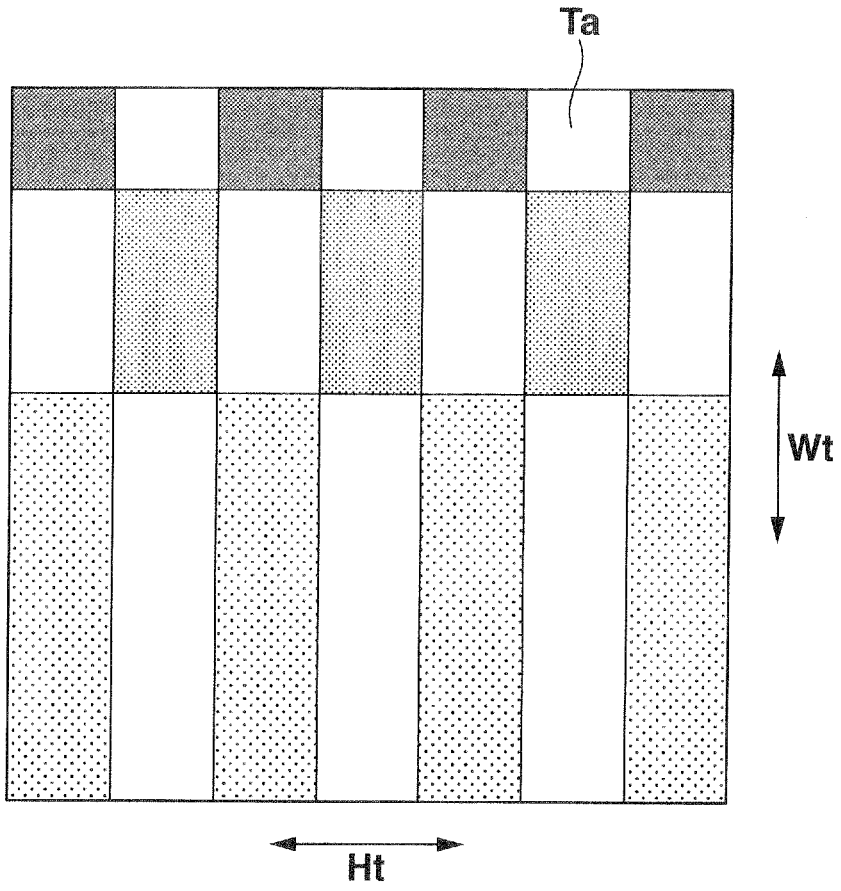
FIG. 13 is an enlarged diagram of a region near point A in the nail region shown in FIG. 12B when the design is printed at a constant printing pitch to the entire nail region.

FIG. 13 is an enlarged view of a region near point A in the nail region shown in FIG. 12B when printing is performed at a constant printing pitch in the entire nail region.

Here, the case wherein the nail design of lattice design having a constant intervals is to be printed in the entire nail region Ta which is the surface (print target surface) of a nail portion T (print target subject) which has curve-shape where the center part thereof in the width direction (Wt in FIGS. 12A and 12B, for example) is raised and the height lowers as approaching the edge parts in the width direction Wt as shown in FIGS. 12A and 12B will be discussed.

At this time, when the lattice pattern is printed by spraying ink droplets at a constant spraying frequency per unit time while the recording head 46 is moving at the same printing pitch, that is, at a constant speed for entire nail region Ta, the intervals in the lattice pattern in the length direction Ht of the nail portion T are uniform for the entire nail region Ta.

On the other hand, as shown in FIG. 13, in the areas at the edge parts of the nail region Ta in its width direction Wt where the ΔL values are greater than that in the center part of the nail region Ta in its width direction Wt due to the nail region Ta inclining, the intervals in the lattice pattern in the width direction Wt of the nail portion Ta stretch in the width direction Wt.

Further, because the distance between the ink spraying surface of the recording head 46 and the print target surface becomes longer as the recording head 46 approaches the edge parts of the nail portion T in its width direction Wt, the interval between ink droplets that land on the nail region Ta becomes larger in the edge parts than the interval in the center part of the nail region Ta. Therefore, printing density becomes lighter as the recording head 46 approaches the edge parts of the nail portion T than the printing density in the center part of the nail portion T in its width direction Wt.

Therefore, in order to print an image with no stretching, deformations and the like and to make the printing density in the inclined regions in the nail region Ta at the edge parts thereof in its width direction and the printing density in the center part of the nail region Ta be the same, the printing pitch needs to be smaller in the regions at the edge parts of the nail portion T in its width direction Wt, where the ΔL value is large, than the printing pitch in the center part of the nail portion T in its width direction Wt. In other words, it is necessary to adjust so as to increase the spraying frequency of ink droplets from the recording head 46 in the edge parts of the nail portion T.

Pitch adjustment basis table is a table in which parameters (setting values) for adjusting printing pitch are stored, and pitch adjustment bases table is stored in the ROM 52.

The pitch adjustment basis table is a table wherein parameters which are corresponded so as to make the printing pitch in both edge parts of the nail region Ta in its width direction Wt be smaller comparing to the printing pitch when the print unit 40 performed printing in the center part of the nail region Ta in its width direction Wt, the nail region Ta being the print target surface.

In this embodiment, the ROM 52 functions as a basis table storage unit for storing the pitch adjustment basis table.

This embodiment includes a spraying frequency basis table as the pitch adjustment basis table. In the spraying frequency basis table, a setting values of spraying frequency of ink droplets with respect to each of the plurality of segment regions each of which having a constant width (for example, 100 μm) in the width direction Wt of the nail region Ta is stored as a parameter, the ink droplets being sprayed intermittently from the recording head 46 at the time of printing. When the recording head 46 moves at a constant speed when printing, the setting values correspond to the spraying frequency per unit time, and further correspond to printing pitch. As described later, the setting values are set so that the spraying frequency of ink droplets when printing is performed to the both edge parts of the nail region Ta in its width direction Wt to be greater than the spraying frequency of ink droplets when printing is performed to the center part of the nail region Ta in its width direction Wt by the print unit 40, that is, so that printing pitch in the both edge parts is set to smaller value than the printing pitch in the center part.

Spraying frequency of ink droplets to be sprayed from the recording head 46 to the segment regions in the nail region Ta in its width direction, each having the constant width (for example, 100 μm), is set so as to be proportional to the setting values.

That is, when the spraying frequency of ink droplets corresponding with the setting value "1" is set to "m" number of times and when the setting value is "n", the spraying frequency will be n×m number of times. As the setting value becomes a large value, the spraying frequency of ink droplets increases and the printing pitch becomes smaller.

FIG. 14 is a diagram illustrating an example of the spraying frequency basis table as the pitch adjustment basis table.

As shown in FIG. 14, for example, three types of spraying frequency basis tables are provided according to the above mentioned nail shape patterns A to C.

In the spraying frequency basis table, parameters for setting the spraying frequency of ink droplets are stored so as to correspond respectively with a plurality of segment regions, the segment regions being formed by dividing the nail portion T in 100 μm width units in horizontal direction from its edge in its width direction Wt.

Each column of the width positions in the spraying frequency basis table corresponds to each segment region.

The parameters for setting the spraying frequency of ink droplets are set to values for obtaining approximately equal printing density (hereinafter, called "required density") throughout the entire nail region Ta which is the print target surface, the nail region Ta having a curve-shape where both edge parts in its width direction Wt are low and the center part in its width direction Wt is raised. Here, the recoding density changes according to the interval between ink droplets that land on the print target surface. That is, the narrower the interval between ink droplets, the greater and denser the printing density. Further, the wider the interval between ink droplets, the lower and lighter the printing density.

The parameters for setting the spraying frequency of ink droplets in the spraying frequency basis table are set to values which make the intervals between ink droplets that land on the nail region Ta be approximately equal to each other throughout the entire nail region Ta.

Now, required density rate with respect to width positions in the nail portion T will be described.

Figure 15:
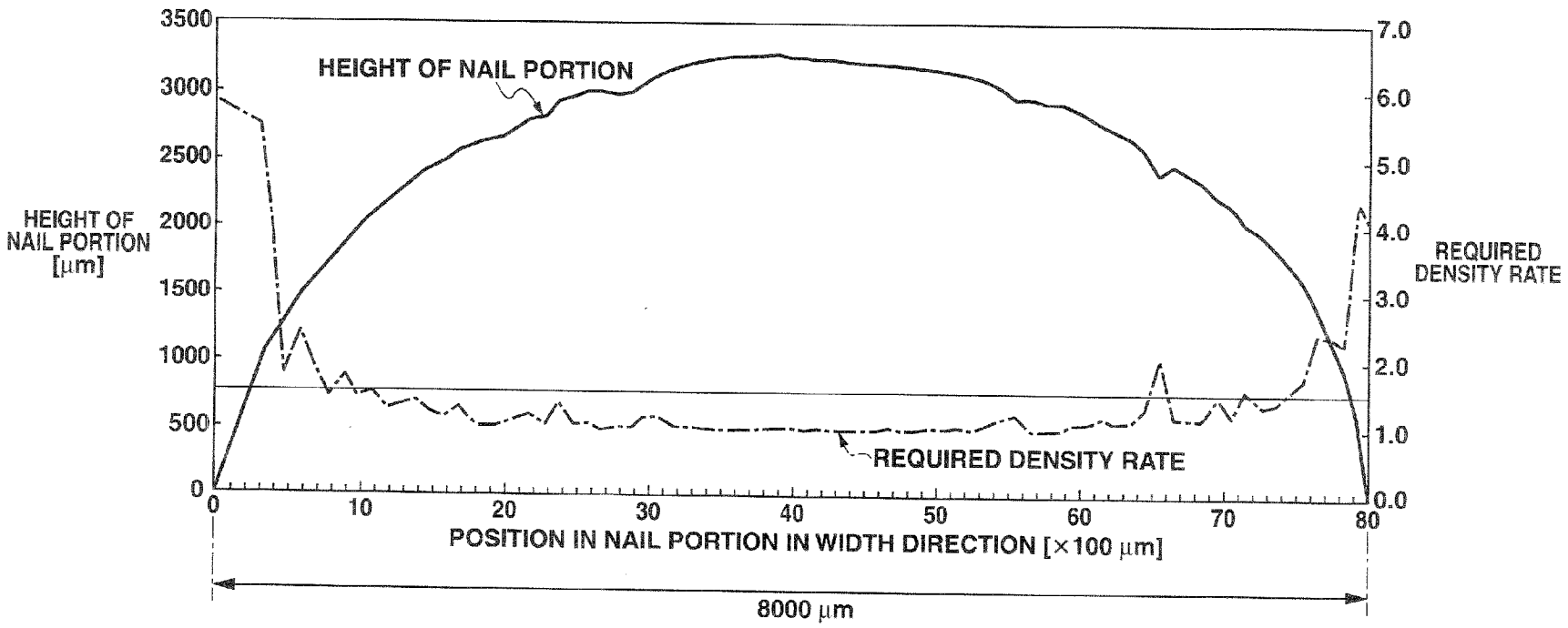
FIG. 15 is a graph showing an example of a relation between heights with respect to positions in the nail portion T in its width direction from one edge part of the nail portion T and the required density rate to obtain required density.

FIG. 15 is a graph which expresses an example of the relation between the heights with respect to positions in the nail portion T in its width direction from an edge part of the nail portion T and the required density rate to obtain the required density.

In FIG. 15, the solid line indicates the height of the curve-shape, and the dashed line indicates the required density rate. As for the curve-shape of the nail portion T, a case where both edge parts in the width direction Wt are low and center part in the width direction Wt is raised which is a general shape of nail portion T is shown, as shown in FIG. 15. In FIG. 15, a case where the size between both edges of the nail portion T in its width direction is 8000 μm and the highest height among the heights of the curve-shape of the nail portion T, which is at the center part in the width direction Wt, is about 3000 μm is shown.

The numeral values (1 to 80) in the horizontal axis in FIG. 15 indicate positions (width positions) from one end of the nail portion T in its width direction, and indicate positions of every 100 μm when the nail portion T is divided in every 100 μm from one end in horizontal direction. The values of width positions in the horizontal axis in FIG. 15 correspond to the numeral values of width positions in FIG. 14.

Reference ink amount is the ink amount required to make the print target surface have the required density by performing printing on the print target surface when the print target surface is a flat surface parallel with the ink spraying surface of the recording head 46.

Required density rate is a ratio of ink amount required to make the print target surface have the required density by performing printing on the print target surface when the print target surface is not parallel with the ink spraying surface of the recording head 46 with respect to the reference ink amount.

Here, the ink amount required to make the print target surface have the required density by performing printing on the print target surface is proportionate to the area of the print target surface.

When the ink amount per one spray of ink droplets sprayed from the recording head 46 is constant, the spraying amount of ink to be sprayed from the recording head 46 to a region having a predetermined area is proportionate to the spraying frequency of ink droplets to be sprayed to the region.

In other words, the spraying frequency of ink droplets to be sprayed from the recording heard 46 required to make the print target surface have the required density by performing printing on the first printing target surface which is parallel with the ink spraying surface of the recording head 46, the length in the width direction Wt being 1 and the length in the length direction Ht being "m", is set to the average spraying frequency which is to be the reference (hereinafter, called "reference spraying frequency). At this time, the required density rate is the ratio of the spraying frequency of ink droplets to be sprayed from the recording head 46 required to make the second print target surface have the required density by performing printing on the second print target surface which is not parallel with the ink spraying surface of the recording head 46, the length in the width direction Wt being 1 and the length in the length direction Ht being "m", with respect to the reference spraying frequency. That is, when the ink amount per one spraying of ink droplets is constant, the required density rate corresponds to the ratio of the area of the second print target surface with respect to the area of the first print target surface.

When the length of the surface of the nail portion T corresponding to the horizontal distance Δx of the curve-shape of the nail portion T in its width direction is ΔL (see FIGS. 11A to 11C), the required density rate corresponds to the value (ΔL/Δx) obtained by dividing ΔL by Δx.

When performing printing on a surface near the center of the nail portion T in its width direction approximately parallel with the ink spraying surface of the recording head 46, the required density rate is "1" because the horizontal distance Δx of the curve-shape of the nail portion T in its width direction and the length size ΔL of the nail portion surface corresponding to the horizontal distance Δx are approximately equal to each other. Further, the required density rate becomes greater as the actual length size ΔL of the nail portion surface corresponding to Δx becomes longer.

The height values of the curve-shape of the nail portion T shown in FIG. 15 are actual measurement values of the nail portion T of an anonymous person.

There are individual differences in the heights and the rising manner of the curve-shape of the nail portion T. However, the individual differences in curve-shapes of nail portions T are nor to a great extent, and curve-shapes of nail portions of many people are approximately in the shape as shown in FIG. 15.

In such case, for example, the required density rate value (ΔL/Δx) is "1" which is approximately constant in the parts in the nail region where curved for a small degree forming a rounded surface, the parts being inside than the regions 100 μm toward the center part from the right and left edges in the width direction, as shown in FIG. 15. That is, the required density can be obtained in these regions when printing is performed for the number of times of ink spraying (spraying frequency) which is approximately equal to that when performing printing to the flat surface.

On the other hand, in the regions which are about 1000 μm to ward the center part from right and left edges in the width direction, the required density rate is larger than 1. Further, in the regions nearest to the edges have required density rate value of about 4.

In the spraying frequency basis table shown in FIG. 14, values of required density rate with respect to positions in the width direction of the nail portion T are stored as parameters.

As shown in FIG. 14, "1" is stored as the parameter with respect to each of the positions at the center part and near the center part of the nail portion T in its width direction. At this time, the spraying frequency of ink droplets to be sprayed from the recording head 46 is the reference spraying frequency.

On the other hand, either 2, 3 or 4 which indicate that the spraying frequency of ink droplets to be sprayed from the recording head 46 becomes 2 to 4 times the reference spraying frequency is stored, as a parameter, with respect to each of the positions at the edge parts of the nail portion T so as to correspond with the positions in the nail portion T in its width direction.

Here, as shown in FIG. 15, the parts in the nail portion T in which the required density rate is other than 1 (that is, the parts where pith adjustment is necessary) are within the ranges of 2000 μm from the edge parts of the nail portion T in its width direction toward the center part of the nail portion T. Therefore, the spraying frequency basis table shown in FIG. 14 is set for the width positions 1 to 20, in other words, within the ranges of 2000 μm from the edge parts of the nail portion T in its width direction toward the center part.

Further, the nail portion T is almost bilaterally symmetric, setting the center part in its width direction as the center. Therefore, as shown in FIG. 14, the spraying frequency basis table is structured only for the region within 2000 μm (the width positions 1 to 20) from one edge part of the nail portion T in its width direction, and as for the opposite side of the nail portion T in its width direction, the numeral values of the parameters in the spraying frequency basis table corresponding to the above width positions can be applied by reversing the values in their order.

Here, in this embodiment, a case where pitch adjustment basis table is the spraying frequency basis table for adjusting the spraying frequency of ink droplets to be sprayed from the recording head 46 is shown as an example.

However, pitch adjustment basis table is not limited to the spraying frequency basis table, and any table can be applied as long as it can adjust the spraying frequency of ink to be sprayed from the recording head 46.

Spraying amount of ink is a value where the ink amount of ink droplets per one spraying is multiplied by the spraying frequency of ink droplets.

Therefore, pitch adjustment basis table may be a table for adjusting the ink amount of ink droplets per one spraying. Alternatively, pitch adjustment basis table may be a table for adjusting both the ink amount of ink droplets per one spraying and the spraying frequency of ink.

As shown in FIG. 14, in the spraying frequency basis table corresponding to the nail shape pattern A, "4" (that is, four times the reference spraying frequency) which indicates the largest number of times of spraying is stored as the parameter so as to correspond to column 1 (the width position=1) in the width direction of the nail portion T, for example.

Corresponding to the eight columns (the width positions=2 to 9) that come after column 1, "3" (that is, times the reference spraying frequency) which indicates the second largest number of times of spraying is stored respectively as the parameters.

Further, corresponding to the four columns (the width positions=10 to 13) that come after column 9, "2" (that is, twice the reference spraying frequency) which indicates the third largest number of times of spraying is stored respectively as the parameters.

Then, corresponding to the rest of the columns thereafter (the width positions=14 to 20), "1" corresponding to the reference spraying frequency is stored respectively as the parameters.

In the spraying frequency basis table corresponding to the nail shape pattern B, "3" (that is, three times the reference spraying frequency) is respectively stored as the parameters so as to correspond to the two columns (the width positions=1 and 2) at the most edge in the width direction of the nail portion T.

Corresponding to the six columns (the width positions=3 to 8) that come after column 2, "2" (that is, twice the reference spraying frequency) is respectively stored as the parameters.

Corresponding to the rest of the columns thereafter, "1" which corresponds to the reference spraying frequency is respectively stored as the parameter.

In the spraying frequency basis table corresponding to the nail shape pattern C, "2" (that is, twice the reference spraying frequency) is respectively stored as the parameters so as to correspond to the three columns (the width positions=1 to 3) at the most edge in the width direction of the nail portion T. Corresponding to the rest of the columns thereafter, "1" which corresponds to the reference spraying frequency is respectively stored as the parameters.

The RAM 53 includes a storage region for storing various types of data and such like and a working region (omitted from the drawings) in which programs and suchlike are to be expanded when the control unit 51 performs various types of processing.

In the embodiment, (1) a nail region image as a print target region image which is photographed by the photographing unit 30, (2) the length size of the nail region image in its width direction measured by the width measuring unit 511 (see FIG. 9), (3) the height size of the nail portion T in the ink spraying direction of the print unit 40 obtained by the height measuring unit 512, (4) the pattern categorization result of the shape of nail portion T of a user obtained by the table selection unit 513, (5) the spraying frequency adjustment tables (see the after-mentioned FIGS. 16 to 19) as pitch adjustment tables corresponding to the shape of nail portion T of a user, the spraying frequency adjustment table being generated by the adjustment table preparing unit 514 based on the spraying frequency basis table, (6) printing data which is generated by the printing data generation unit 515 and such like are stored in the storage region of the RAM 53.

When seen from a functional viewpoint, the control unit 51 includes the width measuring unit 511, the height measuring unit 512, the table selection unit 513, the adjustment table preparing unit 514, the printing data generation unit 515, the print control unit 516, the display control unit 517 and the like.

Functions as the above width measuring unit 511, height measuring unit 512, table selection unit 513, adjustment table preparing unit 514, printing data generation unit 515, print control unit 516, display control unit 517 and the like are realized by the CPU and the programs stored in the ROM 52 cooperating with each other.

The width measuring unit 511 measures the length size of the nail region image (that is, the print target region image) in its width direction, the nail region image being obtained by the photographing unit 30.

Here, the method for the width measuring unit 511 to measure the length of a nail region image in its width direction is not particularly limited. For example, a method for obtaining the length of a nail region image in its width direction from the number of pixels in the nail region image by comparing the number of pixels in the nail region image obtained by the photographing unit 30 to the number of pixels in the reference length, the number pixels in the reference length being measured and stored in the ROM 52 or the like in advance, can be applied.

In this embodiment, the width measuring unit 511 first obtains the length (that is, the length between a0 and b0) of the line connecting the left and right stress points SpL and SpR shown in FIG. 9 (this is set to "the reference line a0 to b0) in its width direction from the nail region image as the width size of the reference line a0 to b0. Next, with respect to a plurality of measuring points above and below the reference line a0 to b0, their width sizes in the nail region image are obtained by the method similar to the method by which the width size of the reference line a0 to b0 is obtained, for example.

Here, in this embodiment, the reference line a0 to b0 is the line connecting between the left and right stress points SpL and SpR. However, this is not limitative in any way. For example, the reference line a0 to b0 may be the line connecting position near the stress points SpL and SpR, and further, may be the line connecting the points where the longest length in the nail portion T in its width direction can be obtained, or may be a line connection positions near the points where the longest length in the nail portion T in its width direction can be obtained.

For example, FIG. 9 illustrates an example in which width sizes of the first line a1 to b1, the second line a2 to b2 and the third line a3 to b3 which are below the reference line a0 to b0 are obtained in addition to the width size of the reference line a0 to b0. Here, the width size of the reference line a0 to b0 is 10000 μm, the width size of the first line a1 to b1 is 8000 μm, the width size of the second line a2 to b2 is 5000 μm and the width size of the third line a3 to b3 is 200 μm.

The width sizes of how many lines are to be obtained by the width measuring unit 511 is not specifically limited. As the width sizes of more lines are obtained, the shape of the nail region image can be accurately recognized and highly accurate printing can be performed.

The height measuring unit 512 obtains the nail region image including slit images which is photographed by the photographing unit 30, and analyses the slit images. Thereby, the height measuring unit 512 calculates the height of the surface (the nail region Ta) of the nail portion T (print target subject) from the edge parts of the nail portion T in the ink spraying direction of the recording head 46 of the print unit 40.

The height measuring unit 512 includes a height measuring section which measures the size of the nail portion T in its height direction in addition to the photographing unit 30.

In this embodiment, the height measuring section measures at least the height direction size at the position ("the reference position P" in FIG. 10) which is 1000 μm from one edge of the nail portion T in its width direction on the line connecting the left and right stress points SpL and SpR.

The method performed by the height measuring unit 512 to measure the height size of the nail region Ta of the nail portion T in the ink spraying direction of the print unit 40 is not specifically limited. In this embodiment, the height of the nail portion T is calculated from the difference in the slit images formed on the surface of the nail portion T due to the difference in height. Moreover, for example, when a side of the nail portion T is photographed by the photographing unit 30 by irradiating the side of the nail portion T with a spot light, the height measuring unit 512 calculates the height of the nail portion T based on the obtained spot light image.

Here, it is preferred that the height measuring unit 512 measures the height sizes at a plurality of points in the nail portion T which is the print target subject to obtain the height sizes of a plurality of points in the nail portion T in order to perform even more highly accurate printing. In such case, the photographing unit 30 performs photographing by irradiating a plurality of points in the nail portion T with slit lights, and the height measuring unit 512 calculates the height of each of the points in the nail portion T based on the obtained slit images.

The table selection unit 513 selects the spraying frequency basis table which matches the nail shape pattern of the nail portion T among a plurality of types of spraying frequency basis tables corresponding respectively with a plurality of nail shape patterns stored in the ROM 52 which is the basis table storage unit according to the height size of the nail region Ta of the nail portion T obtained by the photographing unit 30 and the height measuring unit 512.

As described above, in this embodiment, three types of spraying frequency basis tables corresponding respectively to the three types of nail shape patterns A to C are stored in the ROM 52, and the table selection unit 513 categorizes the nail portion T shape according to the height size of the nail region Ta of the nail portion T from the edge part of the nail portion T and selects the spraying frequency basis table which best matches the shape of the nail portion T.

For example, when the height of the reference position P of the nail portion T which is the print target subject is higher than 2000 μm, the nail portion T is categorized as the nail shape pattern A (see FIG. 10), and the table selection unit 513 selects the spraying frequency basis table (see FIG. 14) of pattern A corresponding to the nail shape pattern A.

When the height at the reference position P of the nail portion T is between 1000 μm and 2000 μm, the nail portion T is categorized as the nail shape pattern B (see FIG. 10), and the table selection unit 513 selects the spraying frequency basis table (see FIG. 14) of pattern B corresponding to the nail shape pattern B.

When the height at the reference position P of the nail portion T is lower than 1000 μm, the nail portion T is categorized as the nail shape pattern C (see FIG. 10), and the table selection unit 513 selects the spraying frequency basis table (see FIG. 14) of pattern C corresponding to the nail shape pattern C.

The adjustment table preparing unit 514 prepares a spraying frequency adjustment table based on the spraying frequency basis table (pitch adjustment basis table) stored in the ROM 52 which is the basis table storage unit. The spraying frequency adjustment table is a specific pitch adjustment table to be applied for performing printing to a nail region Ta (print target surface) corresponding to the length of the nail region image (print target region image) in its width direction measured by the width measuring unit 511.

The adjustment table preparing unit 514 first prepares a spraying frequency adjustment table which will be the reference. Next, the adjustment table preparing unit 514 prepares a spraying frequency adjustment table for each line based on the above reference spraying frequency adjustment table.

For example, with respect to the nail portion T shown in FIG. 9, a case where a spraying frequency adjustment table is prepared for each line will be described.

FIG. 16 is a diagram illustrating an example of the spraying frequency adjustment table when the width size of the line is 10000 μm.

FIG. 17 is a diagram illustrating an example of the spraying frequency adjustment table when the width size of the line is 8000 μm.

FIG. 18 is a diagram illustrating an example of the spraying frequency adjustment table when the width size of the line is 5000 μm.

FIG. 19 is a diagram illustrating an example of the spraying frequency adjustment table when the width size of the line is 200 μm.

The adjustment table preparing unit 514 first prepares the spraying frequency adjustment table (see FIG. 16) of the reference line a0 to b0 based on the spraying frequency basis table as the spraying frequency adjustment table which is to be the reference.

As described above, in this embodiment, the width positions (columns 1 to 20 in FIG. 14) in the spraying frequency basis table correspond to the segment regions, each of which having 100 μm width, from the edge when the range of 2000 μm from each edge of the nail portion T in its width direction is divided in every 100 μm in the horizontal direction. Further, the spraying frequency basis table is a table in which a setting value for spraying frequency of ink allocated to each column is stored in the respective column in the width positions.

In the spraying frequency adjustment table for the reference line a0 to b0, the setting value for spraying frequency which is assigned to each column of the width positions 1 to 20 in the spraying frequency basis table are assigned to column 1 to column 20, in this order, from each of the right and left edges of the reference line a0 to b0 toward the center part thereof in the width direction (see FIG. 16).

In such way, as shown in FIG. 16, setting values of spraying frequency of column 1 to column 20 (the width positions=1 to 20) and column 81 to column 100 (the width positions=81 to 100) in the reference line a0 to b0 in which the width size thereof is 10000 μm are decided.

Further, in each of the remaining column 21 to column 80 (the width positions=21 to 80), the setting value for spraying frequency "1" is assigned.

As a result, the spraying frequency adjustment table a0 to b0 in which the setting value for spraying frequency which is equal to or greater than "2" is assigned to each of the positions within the range of 1300 μm from both edges of the nail portion T (that is, the width positions 1 to 13 and the width positions 88 to 100) and the setting value for spraying frequency "1" is assigned to the remaining center part of the nail portion T in its width direction (that is, the width positions 14 and 87) is prepared.

Next, by setting this spraying frequency adjustment table a0 to b0 as the reference, the spraying frequency adjustment table for another part in the nail portion T having the width size ax to bx is to be prepared.

In particular, when the width size ax to bx is longer than the length of the reference line a0 to b0 corresponding to the spraying frequency adjustment table a0 to b0 ("length of ax to bx">"length of a0 to b0"), the spraying frequency adjustment table ax to bx for the length ax to bx is prepared by adjusting the spraying frequency adjustment table a0 to b0 so as to increase the part where the setting value for spraying frequency "1" is assigned (that is, the columns in which the setting value for spraying frequency "1" is assigned) for the difference between the length ax to bx and the length a0 to b0.

On the other hand, when the width ax to ab is shorter than the length of the reference line a0 to b0 corresponding to the spraying frequency adjustment table a0 to b0 ("length of ax to bx"<"length of a0 to b0"), the spraying frequency adjustment table a0 to b0 is scaled down as a whole so as to correspond to the ratio of "length ax to bx"/"length a0 to b0".

That is, the spraying frequency adjustment table a0 to b0 is adjusted so as to decrease the number of columns in the center part of the spraying frequency adjustment table a0 to b0 where the setting value for spraying frequency "1" is assigned by the rate corresponding to the above ratio of the lengths.

As for the edge parts where the setting value for spraying frequency equal to or greater than "2" is assigned, the number of columns as a whole in each of the edge parts is reduced according to the ratio of "length ax to bx"/"length a0 to b0". However, reducing is performed from the parts where the setting value for spraying frequency is large in each of the edge parts.

In other words, for example, in the case of the first line a1 to b1 shown in FIG. 17 in which the width size of the line is 8000 μm, the spraying frequency adjustment table a0 to b0 is scaled down as a whole so as to correspond with the ratio of 8000 μm/10000 μm. As a result, the part from column 14 to column 87 in the spraying frequency adjustment table a0 to b0 where the setting value for spraying frequency "1" is assigned is reduced to sixty columns which are from column 11 to column 70. As for the edge parts, the part from column 1 to column 13 and the part from column 88 to column 100 in the spraying frequency adjustment table a0 to b0 where the setting value for spraying frequency equal to or greater than "1" is assigned, each part including thirteen columns, are reduced to ten columns each that are from column 1 to column 10 and from column 71 to column 80. When the number of columns is to be reduced, the reducing is performed from the edge parts where the parts where the setting values of spraying frequency "4" and "3" are assigned.

In the case of the second line a2 to b2 shown in FIG. 18 in which the width size of the line is 5000 μm, the spraying frequency adjustment table a0 to b0 is down scaled as a whole so as to correspond with the ratio of 5000 μm/10000 μm. As a result, the part from column 14 to column 87 in the spraying frequency adjustment table a0 to b0 where the setting value for spraying frequency "1" is allocated, the part including seventy four columns, is reduced to thirty seven columns from column 8 to column 43. As for the edge parts, the part from column 1 to column 13 and the part from column 88 to column 100 in the spraying frequency adjustment table a0 to b0 where the setting value for spraying frequency equal to or greater than "1" is assigned, each part including thirteen columns, are reduced to seven columns each, that is from column 1 to column 7 and from column 44 to column 50. When the number of columns is to be reduced, the reducing is performed from the edge parts where the setting values for spraying frequency "4" and "3" are assigned.

Further, in the case of the third line a3 to b3 shown in FIG. 19 in which the width size of the line is 200 μm, there are two columns in the entire spraying frequency adjustment table, and the spraying frequency adjustment table a0 to b0 is reduced as a whole so as to correspond with the ratio of 200 μm/10000 μm. As a result, the part from column 14 to column 87 in the spraying frequency adjustment table a0 to b0 where the setting value for spraying frequency "1" is assigned, the part including seventy four columns, is removed entirely, and the setting value for spraying frequency "3" is assigned to the two columns.

Here, in the case where the width size of ax to bx equals the width size of the reference line a0 to b0 corresponding to the spraying frequency adjustment table, the spraying frequency adjustment table a0 to b0 can be used as the spraying frequency adjustment table ax to bx as it is.

The printing data generation unit 515 generates printing data corresponding to the width size of the nail region Ta (print target region) which is measured by the width measuring unit 511 from the original image data stored in the ROM 52 which is the original image data storage unit according to the spraying frequency basis table (pitch adjustment basis table) stored in the ROM 52 which is the basis table storage unit.

In this embodiment, the printing data generation unit 515 generates printing data according to the spraying frequency adjustment table of each line which is prepared based on the spraying frequency basis table.

In this embodiment, the printing data generation unit 515 generates printing data from the original image data by referring to the spraying frequency adjustment table of each line which is prepared by the adjustment table preparing unit 514.

Figure 20A:
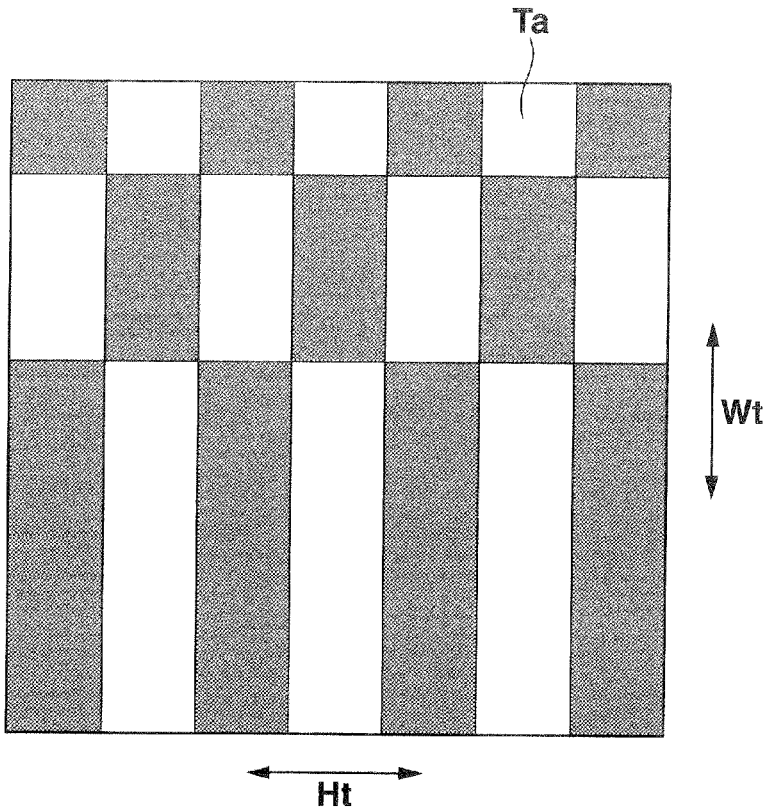
FIG. 20A is an enlarged diagram of a region near point A in the nail region shown in FIG. 12B when the spraying frequency is adjusted to perform printing.
Figure 20B:
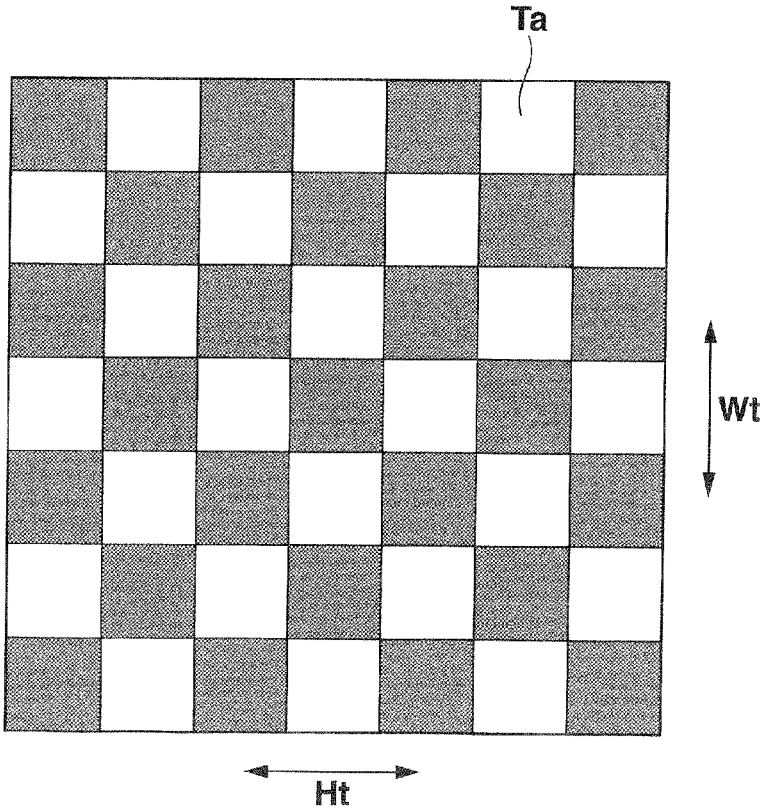
FIG. 20B is an enlarged diagram of a region near point A in the nail region shown in FIG. 12B when thinning printing is performed along with adjustment of spraying frequency.

FIG. 20A is an enlarged diagram of the region near point A in the nail region shown in FIG. 12B when the spraying frequency is adjusted to perform printing, and FIG. 20B is an enlarged diagram of the region near point A in the nail region shown in FIG. 12B when the spraying frequency is adjusted and thinning printing is performed.

When the spraying frequency of ink is not adjusted, printing density becomes lighter as approaching the edges as shown in the above described FIG. 13. In contract, by adjusting the spraying frequency of ink so as to be increased as approaching the edges as in the present invention, almost constant printing density can be maintained all the way to the edges as shown in FIG. 20A.

The print control unit 516 outputs the printing data which is generated by the printing data generation unit 515 to the print unit 40 and controls the print unit 40 so as to perform printing to the nail region Ta (print target surface) of the nail portion T (print target subject) according to the printing data.

For example, when ink is to be sprayed to the region corresponding to the second line a2 to b2, the spraying frequency adjustment table a2 to b2 shown in FIG. 18 is referred to and the spraying frequency of ink to the nail region Ta corresponding to the first column 1 is to be the number of times of spraying corresponding to the setting value "3" in the spraying frequency adjustment table a2 to b2 when the recording head 46 moves in the right side direction from the left edge of the nail portion.

Here, for example, when four sprayings is set to the setting value "1", ink is sprayed for twelve times (=4 times×3) while the recording head 46 moves for 100 μm in the horizontal direction to perform printing for 100 μm (for one column in the spraying frequency adjustment table a2 to b2) in the horizontal direction. Next, the setting value "3" in the spraying frequency adjustment table a2 to b2 corresponding to the next two columns is referred to and printing is performed in the similar manner.

As described above, printing is performed to the entire nail region Ta according to the width size of the nail region Ta.

At this time, when printing is performed according to the printing data without any adjustment, the design can be stretched and deformed at the edges causing a deformed shape to be printed as shown in FIG. 20A.

In view of the above problem, in this embodiment, the print control unit 516 controls generation of stretches and deformations in the design in the edges by arbitrarily thinning the printing data when outputting the printing data which is generated by the printing data generation unit 515 to the print unit 40.

Figure 21:
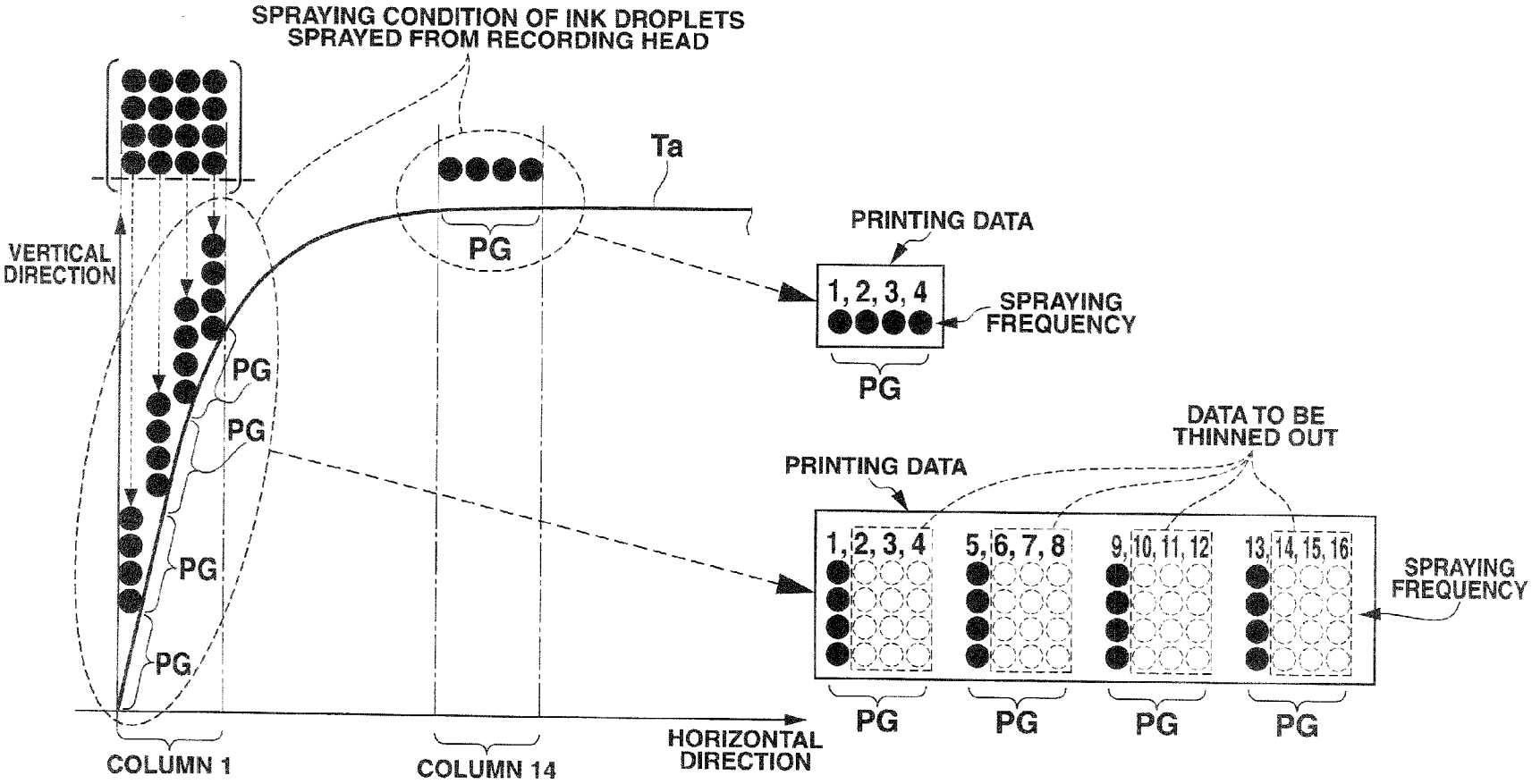
FIG. 21 is a conceptual diagram for explaining the thinning printing in the first embodiment.

FIG. 21 is a schematic diagram for explaining the thinning printing performed in this embodiment.

The printing data is constituted of a plurality of printing pixels based on printing resolution for forming a nail design image on a nail portion T. One printing pixel corresponds to a region on the nail portion T where printing is to be performed by spraying ink for one time or a predetermined plurality of times from the recording head 46, and one printing pixel corresponds to one dot. Each of the numbers 1 to 16 shown in FIG. 21 expresses one printing pixel. In FIG. 21, four printing pixels are shown as one (one group of) printing pixel group PG for the sake of convenience. Further, one printing pixel is shown as a pixel to be printed by one spraying of ink.

In the following description, the description is given for a case where one printing pixel is printed by one spraying of ink for the sake of convenience.

Here, for example, in a case where one printing pixel is to be printed by ten sprayings of ink, the spraying frequency in the following description is to be tenfold.

Here, as shown in FIG. 21, four printing pixels (=one printing pixel group PG) is provided in the region of 100 μm in the horizontal direction corresponding to one column in the spraying frequency adjustment table in the flat part, and printing is to be performed by four sprayings of ink.

On the other hand, when the setting value for spraying frequency "4" is assigned to one column at the edge parts of the nail portion T as in the spraying frequency adjustment table a0 to b0 shown in FIG. 16 and four sprayings correspond to the setting value "1", ink is to be sprayed for 16 times (=4 times×4) while the recording head 46 moves for 100 μm in the horizontal direction in the edge parts. Thereby, the printing pitch in the edge parts is set to be ¼ of that in the flat part.

In this case, as shown in FIG. 21, the surface of the edge parts of the nail portion T are inclined in the regions corresponding to the edge parts, the length along a line ax to bx in the surface is four times the length in the flat part. That is, the surface of an edge part of the nail portion T has a length corresponding to 4 printing pixel groups along the line ax to bx. In contrast, the print control unit 516 thins out the data corresponding to three printing pixels among the four printing pixels in each printing pixel group PG in the printing data, that is, thins out data corresponding to the printing pixels of 2, 3, 4, 6, 7, 8, 10, 11, 12, 14, 15 and 16 and outputs the thinned data to the print unit 40. In such way, only the data corresponding to printing pixels 1, 5, 9 and 13 in the printing data is output to the print unit 40, and as a result, the image is to be in a form compressed to ¼. Thereby, the image which is compressed to ¼ is to be printed in the edge parts by spraying ink for the number of times of spraying which is four times the spraying frequency in the flat part, wherein the printing pitch is set to ¼ of the printing pitch in the flat part. At this time, the surfaces of the edge parts of the nail portion T each has a length corresponding to four printing pixel groups along the line ax to bx. Therefore, the spraying frequency of ink droplets per one printing pixel group is to be four times which is equal to that in the flat part. In such way, the image printed at each of the edge parts in the nail portion T is printed on the nail region Ta which is the print target surface with a density equal to that in the flat part in a fourfold stretched condition. In other words, when the setting value for spraying frequency is "4", for example, the thinning of printing data is performed by taking out ¾ of data to obtain ¼ of data. When the setting value for spraying frequency is "3", ⅔ of data is taken out to obtain ⅓ of data. When the setting value for spraying frequency in "2", ½ of data is taken out to obtain ½ of data. When the setting value for spraying frequency is "1", thinning is not performed. That is, when the setting value for spraying frequency is "n", (n−1)/n of data is taken out to obtain 1/n of data.

Thereby, although resolution may be degraded due to pixels being taken out, printing can be performed in a condition where the printing density is even all the way to the edge parts wand generation of stretching, deforming and unevenness of design is controlled.

The display control unit 517 is a display control unit which displays various types of displays in the display unit 13.

In this embodiment, the display control unit 517 makes the display unit 13 display a design selection screen, a design confirmation screen, various types of instruction screens and such like as described above.

In addition to the above functional units, a nail contour extraction unit as a nail contour extraction section which extracts the contour of a nail portion from a nail region image of the nail portion T included in a finger and nail image which is photographed by the photographing unit 30 in order toe extract the contour of the nail portion T from the finger and nail image.

Further, when a plurality of finger and nail images (images of printing fingers U1 including nail region images of nail portions T) corresponding respectively to a plurality of printing fingers U11 are obtained by the photographing unit 30 with respect to a plurality of printing fingers U1, a finger type detection unit as a finger type detection section which detects the type of each finger from each finger and nail image can be provided at the control unit 51. In such case, the finger type detection unit detects the finger type of each finger and nail image based on the disposition, length size, width size and the like of the finger and nail image, for example.

Next, the print control processing performed in this embodiment will be described.

Figure 22:
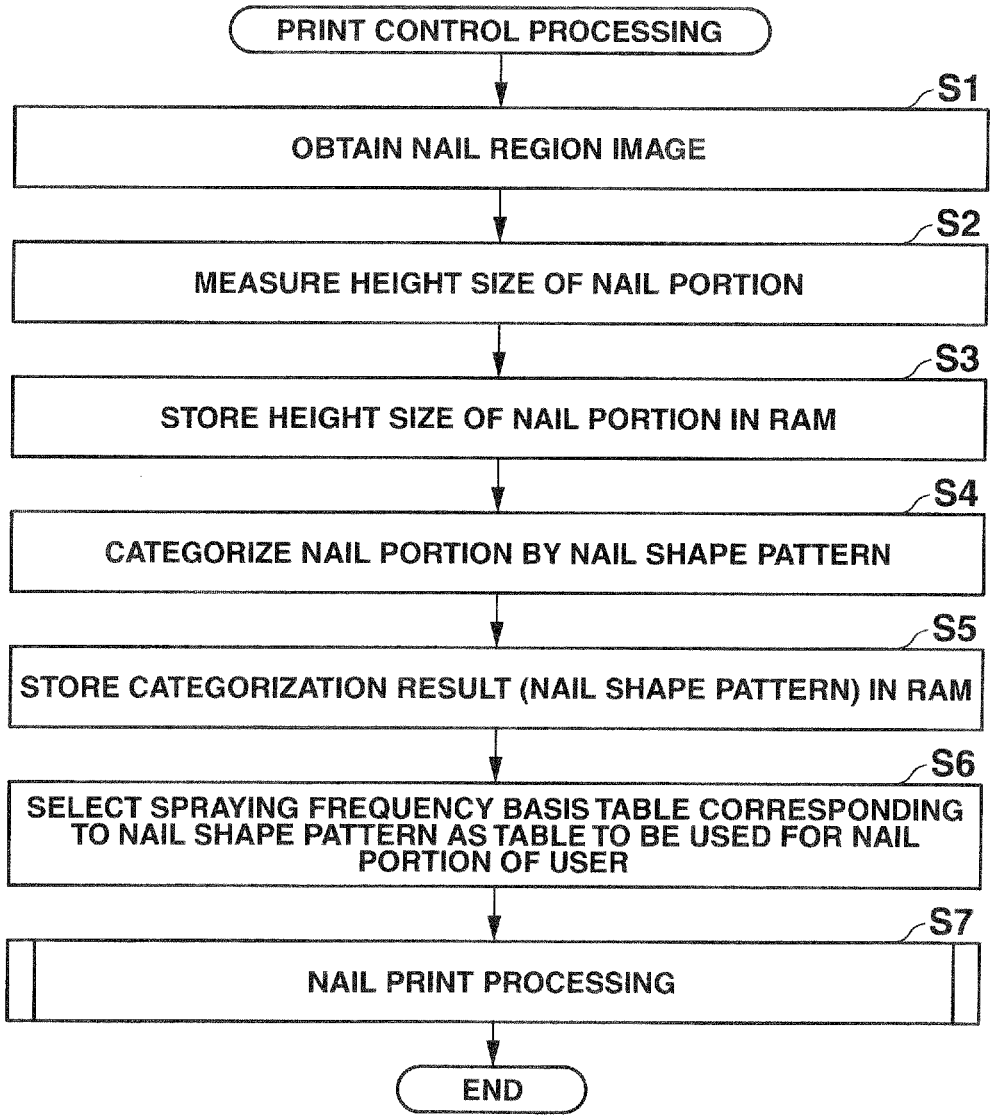
FIG. 22 is a flowchart showing an overall flow of the print control processing in the first embodiment.

FIG. 22 is a flowchart showing the overall flow of the print control processing performed in this embodiment.

Figure 23:
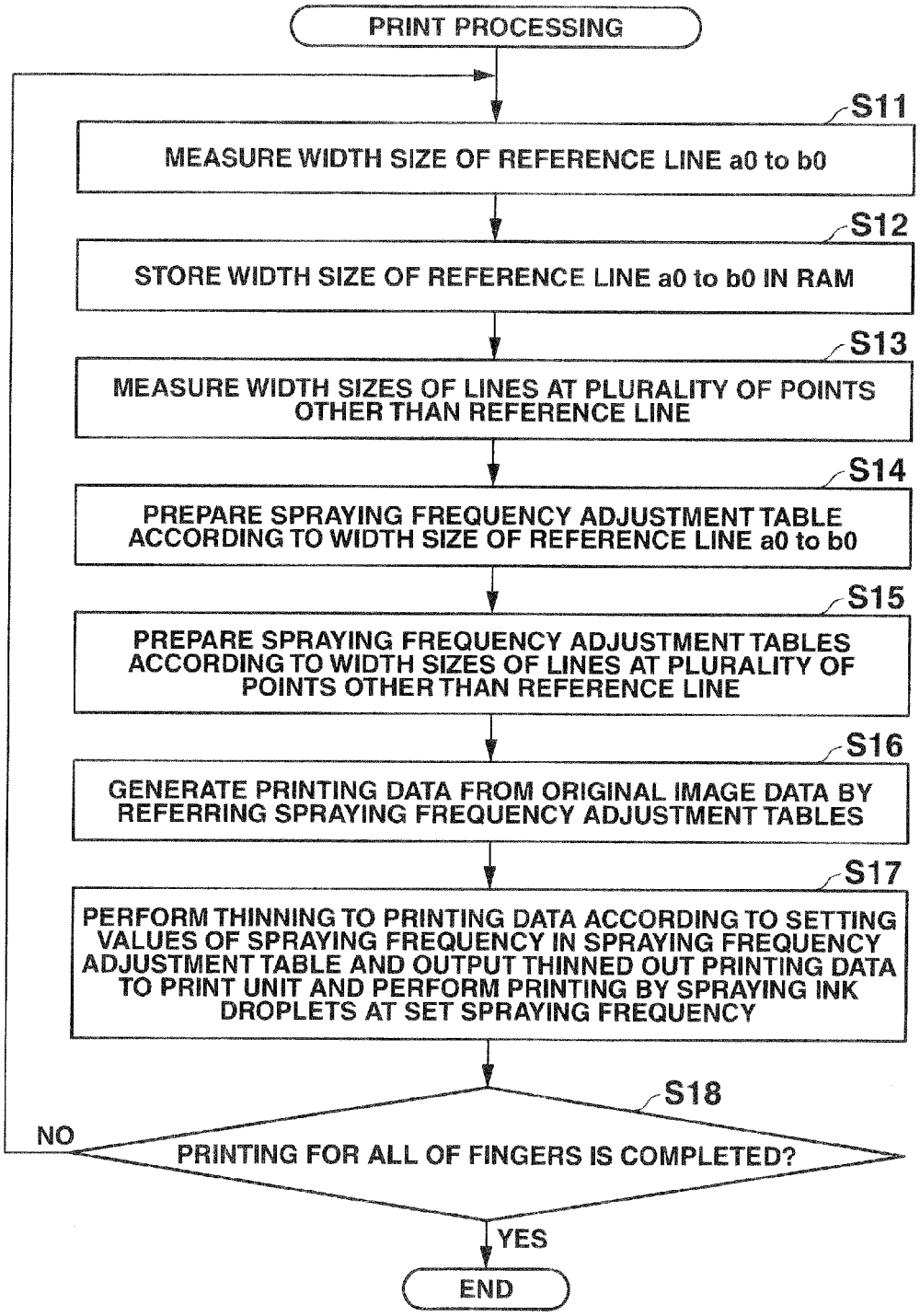
FIG. 23 is a flowchart showing the nail print processing in the print control processing of FIG. 22.

FIG. 23 is a flowchart showing the nail print processing which is to be performed in the print control processing of FIG. 22.

First, the overall flow of the print control processing will be described.

As shown in FIG. 22, as for the overall flow of the print control processing, a nail region image (an image of a nail region Ta which is a print target region) of a nail portion T of a user which is a print target subject is obtained by the photographing unit 30 first (step S1).

By the height measuring unit 512 analyzing the image obtained by the photographing unit 30, the height size of the nail region Ta of the nail portion T from an edge part of the nail portion T at the reference position P is measured (step S2).

The obtained height size of the nail portion T is stored in the RAM 53 or the like (step S3).

The table selection unit 513 categorizes the nail portion T of a user into one of the nail shape patterns A, B and C based on the height size of the nail portion T at the reference position P (step S4).

The categorization result (the nail shape pattern) of the table selection unit 513 is stored in the RAM 53 or the like (step S5).

The table selection unit 513 selects the spraying frequency basis table corresponding to the nail shape pattern into which the nail portion T is categorized from the plurality of spraying frequency basis tables stored in the ROM 53 as the spraying frequency basis table to be applied for the nail portion T of this user (step S6).

Then, when the spraying frequency basis table is selected, the nail print processing (see FIG. 23) to print a nail design in the nail region Ta of the nail portion of this user is performed (step S7).

Next, the nail print processing (see step S7 of FIG. 22) will be described.

As shown in FIG. 23, in the nail print processing, the width measuring unit 511 measures the length (width size) of the line which is to be the reference in the width direction of the nail portion T (in this embodiment, the reference line a0 to b0 which is the line connection the stress points SpL and SpR) first (step S11).

Next, the measured width size is stored in the storage unit such as the RAM or the like (step S12).

The width measuring unit 511 obtains the width sizes of lines at plurality of points other then the reference line and stores the obtained width sizes in the RAM or the like (step S13).

Next, the adjustment table preparing unit 514 first prepares the spraying frequency adjustment table a0 to b0 (see FIG. 16) according to the width size of the reference line (in this embodiment, the reference line a0 to b0) based on the spraying frequency basis table (step S14).

Further, the adjustment table preparing unit 514 prepares the spraying frequency adjustment tales (see FIGS. 17 to 19) corresponding respectively to the width sizes of lines at plurality of points other than the reference line (step S15).

The printing data generation unit 515 refers to the prepared spraying frequency adjustment tables and generates printing data from the original image data (step S16).

Then, the print control unit 516 performs thinning of the printing data according to the setting values for spraying frequency in the spraying frequency adjustment tables and outputs the thinned printing data to the print unit 40. Thereafter, the recording head 46 sprays ink droplets for the number of times according to the setting values for spraying frequency in the spraying frequency adjustment tables to perform printing (step S17).

The control unit 51 determines whether printing is completed for all of the printing fingers (step S18). When printing is completer for all of the printing fingers (step S18; YES), the processing is ended. When printing is not completed for all of the printing fingers (step S18; NO), the processing from step S11 to step S16 is repeated to the nail portions T of the fingers which are not yet printed.

As described above, according to this embodiment, there is provided a spraying frequency basis table as the pitch adjustment basis table which is set so that the printing pitch when printing is performed by the print unit 40 is to be smaller in the edge parts of the nail region Ta in its width direction than in the center part of the nail region Ta in its width direction, the nail region Ta being the print target surface. According to the spraying frequency basis table, printing data corresponding to the width size of the nail region image of a user is generated from the original image data to be printed on the nail portion T.

In such way, even in the case where printing is to be performed to a print target subject (nail portion T) including a print target surface (nail region Ta) having a curve-shape wherein the distance from the print unit 40 in the ink spraying direction is small at the center part in the width direction and becomes greater as approaching the edge parts in the width direction as in a nail portion T of a human finger, approximately even printing density can be maintained all the way to the edge parts just by planarly and horizontally moving the recording head 46 and not moving the recording head 46 three dimensionally according to the shape of the nail portion T, and a high quality image can be printed.

A plurality of spraying frequency basis tables (in this embodiment, three types corresponding to the nail shape patterns A to C) according to the height of the print target subject (nail portion T) are provided as pitch adjustment basis tables, and the spraying frequency basis table that matches the height of the nail portion T of a user is to be selected. Therefore, just by categorizing the shape of the nail portion T of a user into one of the three types of patterns, the pitch adjustment (spraying frequency adjustment) matching the shape of the nail portion T of a user can be performed. To realize this, it is sufficient that the height measuring unit which is a simple height shape recognition mechanism is provided, and high quality image can be printed in which decreasing in print density and generation of stretching, deformation and the like in design are controlled while realizing low cost and size reduction of the apparatus.

In this embodiment, individual spraying frequency adjustment table (pitch adjustment table) which is to be applied in printing performed to the print target surface corresponding to the length size of the nail region image (print target region image) in its width direction is prepared by the adjustment table preparing unit 514 based on the spraying frequency basis table (pitch adjustment basis table). Therefore, merely the individual spraying frequency adjustment table (pitch adjustment table) is needed to be referred to when the printing data is to be generated, and the print processing can be performed in a simple manner and the time required for the print processing can be shortened.

In this embodiment, as the pitch adjustment basis table, the spraying frequency basis table which is a spraying amount adjustment basis table which is set so that the spraying frequency of ink droplets when performing printing by the print unit is greater in the edge parts of the print target surface in its width direction than in the center part of the print target surface in its width direction. Therefore, even in the case where printing is to be performed to a print target subject (nail portion T) including a print target surface (nail region Ta) having a curve-shape wherein the distance from the print unit 40 in the ink spraying direction is small at the center part in the width direction and becomes greater as approaching the edge parts in the width direction, high quality image can be printed without degradation in the printing density.

Further, in this case, because thinning is further performed to the printing data and the thinned printing data is output to the print unit 40 to be printed, generation of stretching, deformation and the like in the design at the edge parts can be controlled even when printing is to be performed on a curved surface such as the nail portion T. Thereby, high quality image can be printed on a curved surface with a relatively simple method.

Second Embodiment

Next, the second embodiment of the print apparatus according to the present invention will be described with reference to the drawings.

Here, in this embodiment, the pitch adjustment basis table which is provided in the print apparatus is different from that in the first embodiment. Therefore, hereinafter, the points which are different from the first embodiment will be described specifically.

The print apparatus of this embodiment is the nail print apparatus similarly as in the first embodiment, and the configuration of the apparatus is almost similar to that in the first embodiment.

In this embodiment, an image conversion basis table is stored in the ROM 52 of the control device 50 of the nail print apparatus as the pitch adjustment basis table.

The image conversion basis table is for reallocating the printing pixels in the original image data so that more printing pixel group data is to be allocated in the center part of the nail region Ta in its width direction than in the both edge parts of the nail region Ta in its width direction, the nail region Ta being the print target surface.

FIG. 24 is a diagram showing an example of the image conversion basis table as the pitch adjustment basis table.

As shown in FIG. 24, three types of image conversion basis tables are provided according to the nail shape patterns A to C similarly to the spraying frequency basis tables.

The image conversion basis table is for adjusting the allocation amount of printing pixel group data so that almost even printing density (hereinafter, called "required density") can be obtained in the entire nail portion T including a nail region T which is a print target surface having a curve-shape where the edge parts of the nail region Ta in its width direction are low and the center part thereof is raised.

In this embodiment, the table selection unit 513 of the control unit 51 selects an appropriate image conversion table from the three types of image conversion basis tables (see FIG. 24) corresponding to the nail shape patters A to C stored in the ROM 52 according to the height of the nail portion T of a user.

Similarly to the spraying frequency basis tables shown in the first embodiment, in the image conversion basis tables, the width positions (column 1 to column 20 in FIG. 24) correspond to the positions of the segment regions, each having width of 100 μm, from one edge part of the nail portion, the segment regions being formed by dividing the rage in the nail portion which is 2000 μm from one edge part in the width direction is divided in every 100 μm in the horizontal direction. Further, in the image conversion basis table, a value for the number of pieces of printing pixel group data allocated to each column is stored in each column of the width positions.

One piece of printing pixel group data is data corresponding to a plurality of printing pixels. In the configuration shown in the after-mentioned FIG. 29, one piece of printing pixel group data corresponds to four printing pixels.

The adjustment table preparing unit 514 prepares the image conversion adjustment table according to the width size of the nail portion T of a user based on the image conversion basis table which is selected by the table selection unit 513.

The adjustment table preparing unit 514 first prepares the image conversion adjustment table for the reference line a0 to b0 of the nail portion T similarly as in the first embodiment.

FIGS. 25 and 26 are diagrams showing examples of image conversion adjustment tables when the length of the reference line a0 to b0 is 10000 μm.

For example, "d1" of FIG. 25 corresponds to "4" as shown in FIG. 26 according to the image conversion basis table shown in FIG. 24, and "d2" of FIG. 25 corresponds to "3" as shown in FIG. 26 according to the image conversion basis table shown in FIG. 24.

That is, the adjustment table preparing unit 514 allocates the values for the number of pieces of printing pixel group data allocated respectively to columns 1 to 20 in the image conversion basis table to each of the right and left edge parts of the reference line a0 to b0 so as to be in the order of column 1 to column 20 from the edge thereof toward the center part (see FIG. 26).

In such way, as shown in FIG. 26, the value for the number of pieces of printing pixel group data in each of columns 1 to 20 and in each of columns 81 to 100 in the reference line a0 to b0 in which the width size thereof is 10000 μm is decided. Further, with respect to each of the remaining columns 21 to 80, the value for the number of pieces of printing pixel group data "1" is respectively allocated.

As a result, the image conversion adjustment table a0 to b0 in which the number of pieces of printing pixel group data "2" or greater is allocated to the positions in the range of 1300 μm from the edge parts (that is, in each of columns 1 to 13 and columns 88 to 100) and the number of pieces of printing pixel group data "1" is allocated to the remaining center part of the nail portion T in its width direction (that is, in each of columns 14 to 87) is generated.

Moreover, the adjustment table preparing unit 514 prepares individual image conversion adjustment table corresponding to each part of width size ax to bx by reducing or enlarging the image conversion adjustment table corresponding to the reference line a0 to b0 which is the reference.

FIG. 27 is a diagram showing an example of the image conversion adjustment table when the length of the line a2 to b2 is 5000 μm (see FIG. 9).

Here, the preparing method of the image conversion adjustment table corresponding to a part of width size ax to bx is similar to the method described in the first embodiment. Therefore, the description will be omitted.

Figure 28A:
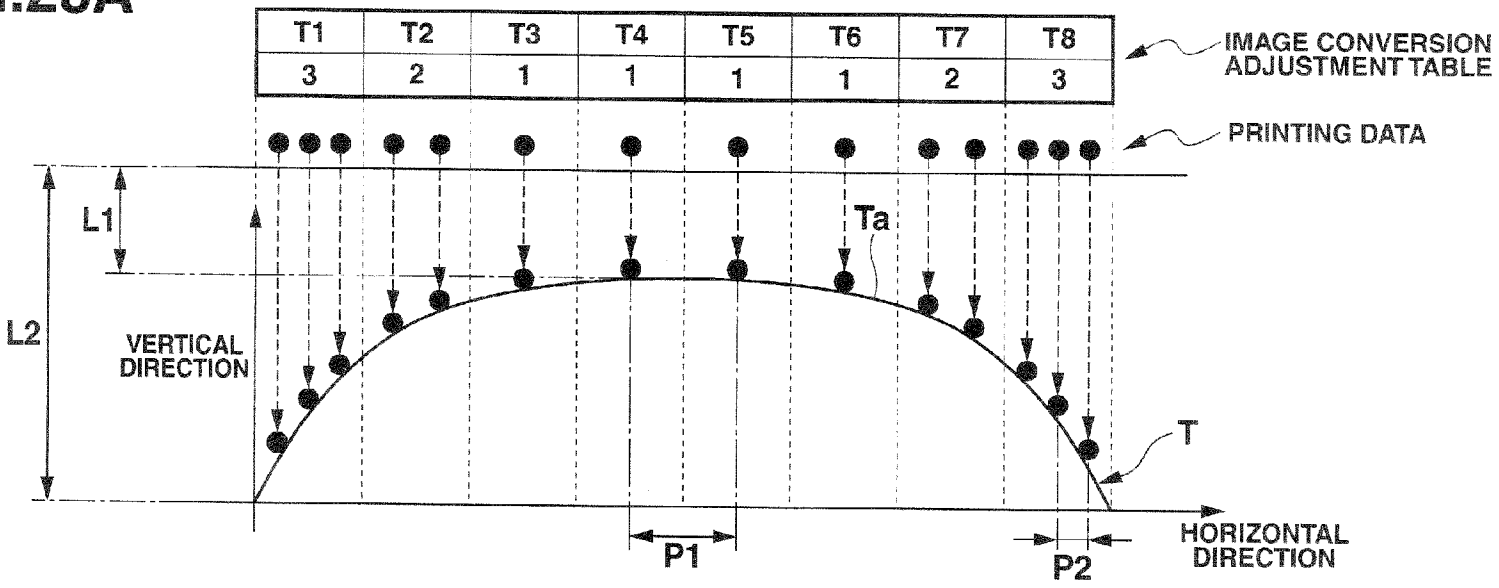
FIG. 28A is a diagram for explaining the configuration of printing data generated by image conversion.
Figure 28B:
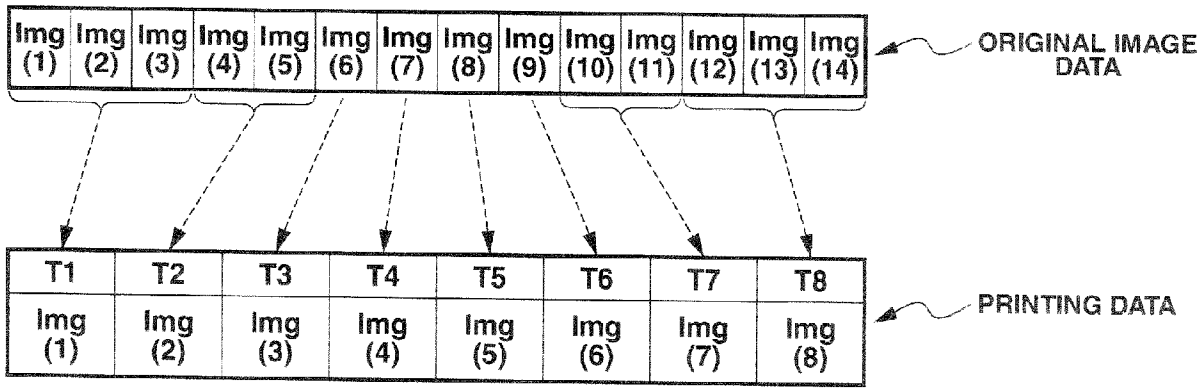
FIG. 28B is an explanatory diagram schematically showing the concept of image conversion to printing data from original image data based on the image conversion adjustment table.

FIG. 28A is a diagram for explaining the configuration of printing data which is generated by the image conversion, and FIG. 28B is an explanatory diagram which schematically shows the concept of image conversion to printing data from original image data based on the image conversion adjustment table.

Here, in FIGS. 28A and 28B, the image conversion adjustment table is structured with columns T1 to T8 in order to simplify the description. Further, as shown in FIG. 28A, "3" pieces of printing pixel group data are allocated to each of column 1 and column 8 and "2" pieces of printing pixel group data are allocated to each of column T2 and column T7, the columns corresponding to the edge parts of the nail portion T, and "1" piece of printing pixel group data is allocated to each of the remaining center parts in the width direction. In FIG. 28A, one black dot corresponds to one piece of printing pixel group data.

At this time, the total number of pieces of data allocated in the columns is "14", and this corresponds to the total number of printing pixel groups.

Because the value "3" is allocated to each of column 1 and column 8 in the image conversion table and three pieces of printing pixel group data among fourteen pieces of printing pixel group data are allocated to each column. Therefore, as shown in FIG. 28A, the printing pitch is set to ⅓ in the regions in the nail potion T corresponding respectively to column 1 and column 8, and printing is performed with a definition three times the definition in the regions in the nail portion T corresponding respectively to columns 3 to 6 in each of which the value "1" is allocated when planarly seen from a surface parallel to the horizontal line. However, the surfaces of the nail portion T in such regions are inclined and the length of each of the regions along a line ax to bx is about three times the length of the regions in the nail portion T corresponding respectively to columns 3 to 6. Therefore, the definition in the regions in the nail portion T corresponding respectively to column 1 and column 8 equals the definition in the regions in the nail portion T corresponding respectively to columns 3 to 6.

Similarly, the value "2" is allocated to each of column 2 and column 7 in the image conversion table and two pieces of printing pixel group data are allocated to each column. Therefore, the printing pitch is set to ½ in the regions in the nail portion T corresponding respectively to column T2 and column 7 and printing is performed with a definition two times the definition in the regions in the nail portion T corresponding respectively to columns T3 to T6 when planarly seen from a surface parallel to the horizontal line. However, these regions in the surface of the nail portion T are inclined and the length of each of the regions along a line ax to bx is about twice the length of each of the regions in the nail portion T corresponding respectively to columns T3 to T6. Therefore, the definition in the regions in the nail portion T corresponding respectively to column 2 and column T7 equals the definition in the regions in the nail portion T corresponding respectively to columns T3 to T6.

In other words, when printing is to be performed to the nail portion T including the nail region Ta having a curve-shape wherein the distance from the print unit 40 in its ink spraying direction is a distance L1 at the center part of the nail portion T in its width direction and the distance becomes greater than the distance L1 (distance L2) as approaching the edge parts of the nail portion T in its width direction, printing data corresponding to the width size of the nail region image is generated from the original image data of an image which is to be printed on the nail region Ta according to the pitch adjustment basis table which is set so that the printing pitch P2 which is applied for printing of the edge parts of the nail region Ta in its width direction is smaller than the printing pitch P1 applied for printing of the center part of the nail region Ta in its width direction. Further, printing is performed to the nail region Ta according to the generated printing data.

Figure 29:
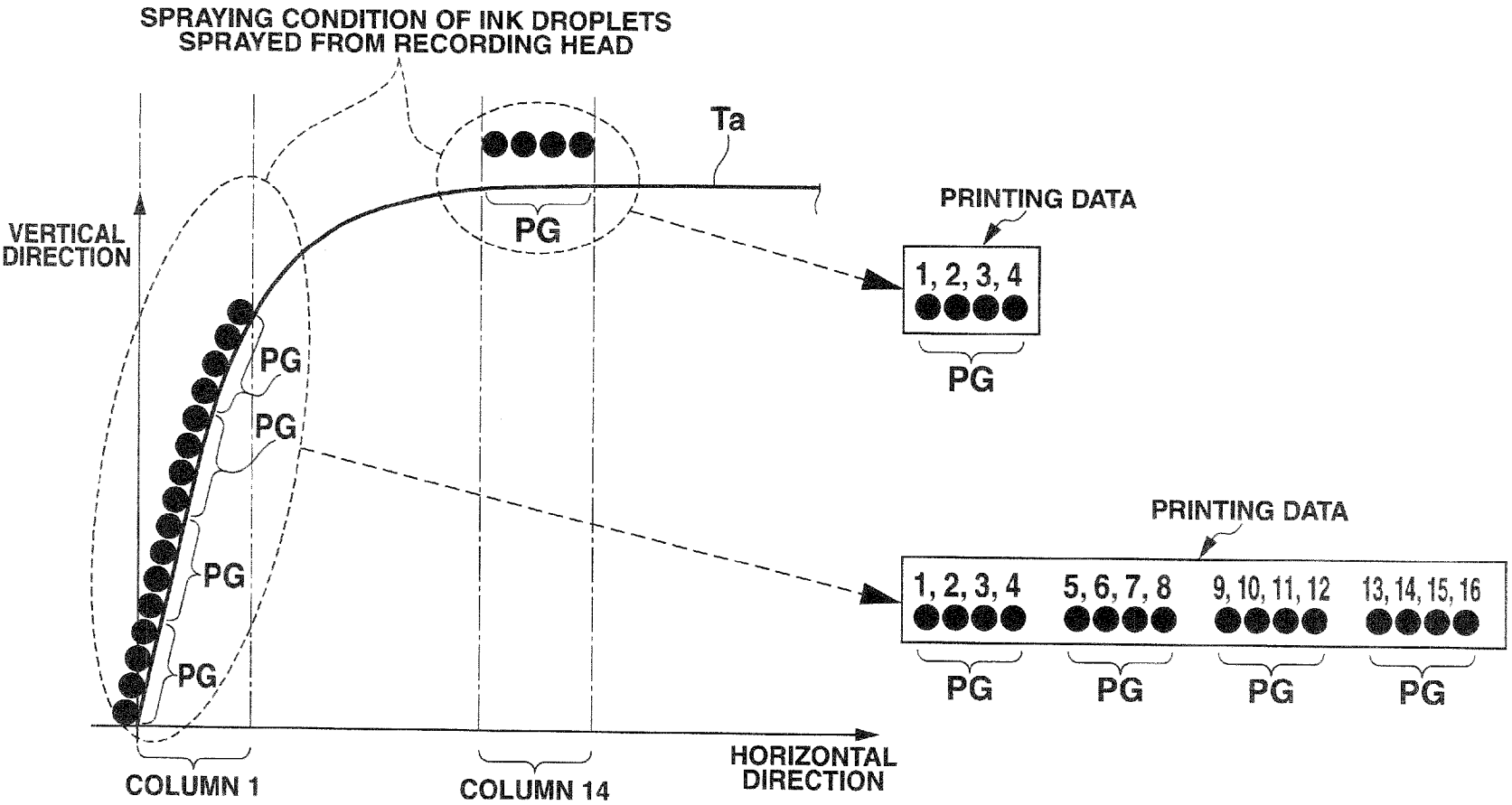
FIG. 29 is a schematic diagram for explaining when printing is performed by applying the image conversion adjustment table.

FIG. 29 is a schematic diagram for explaining a case where printing is performed by using the image conversion adjustment table.

Figure 30:
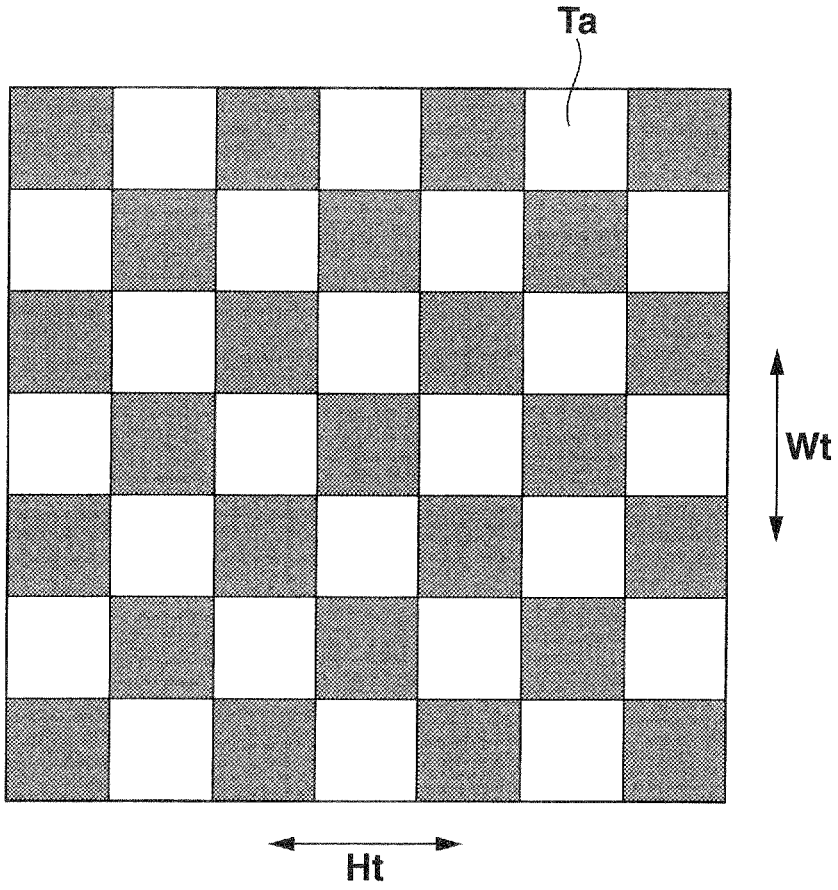
FIG. 30 is an enlarged diagram of a region near point A in the nail region shown in FIG. 12B when printing is performed by applying the image conversion adjustment table.

FIG. 30 is an enlarged image of a region near point A in the nail region shown in FIG. 12B in the case where printing is performed by using the image conversion adjustment table.

For example, when the value "4" is allocated to column 1 corresponding to an edge part of the nail portion T in its width direction in the image conversion adjustment table, the region in the nail portion T corresponding to column 1 is printed with a definition which is four times the definition in the flat part when seen planarly from a surface parallel to the horizontal surface. As shown in FIG. 29, when one printing pixel group PG corresponds to four printing pixels, the spraying frequency of ink to be spraying from the recording head 46 is 16 times (=4×4) corresponding to four printing pixel groups PG in the region corresponding to column 1 at an edge part of the nail portion T. The length of this region along a line ax to bx is about four times the length of the flat surface region. Therefore, the definition in this region in the surface of the nail portion T, the region corresponding to column 1, equals the definition in the flat surface.

In such way, by converting the original image data based on the image conversion basis table, printing according to the shape of the nail portion T can be performed. When the design to be printed (the design in which the original image data is expressed) is printed on the nail portion T in the above described manner, high quality image in which generation of deformations such as stretches and unevenness and the like and degradation in printing density is controlled can be printed as shown in FIG. 30, for example.

Here, when the above described printing accuracy cannot be realized due to capability of the nail print apparatus (that is, when the printing resolution is not enough), thinning is to be performed to the image data appropriately to reach the required resolution capability. Thereby, appropriate printing can be performed so as not to cause stretching and deformation in the design.

The other configurations are similar to those shown in the first embodiment. Therefore, the descriptions are omitted.

Next, the print control processing performed in this embodiment will be described.

Here, the overall flow to the print control processing is similar to that in the first embodiment. Therefore, the description is omitted.

Figure 31:
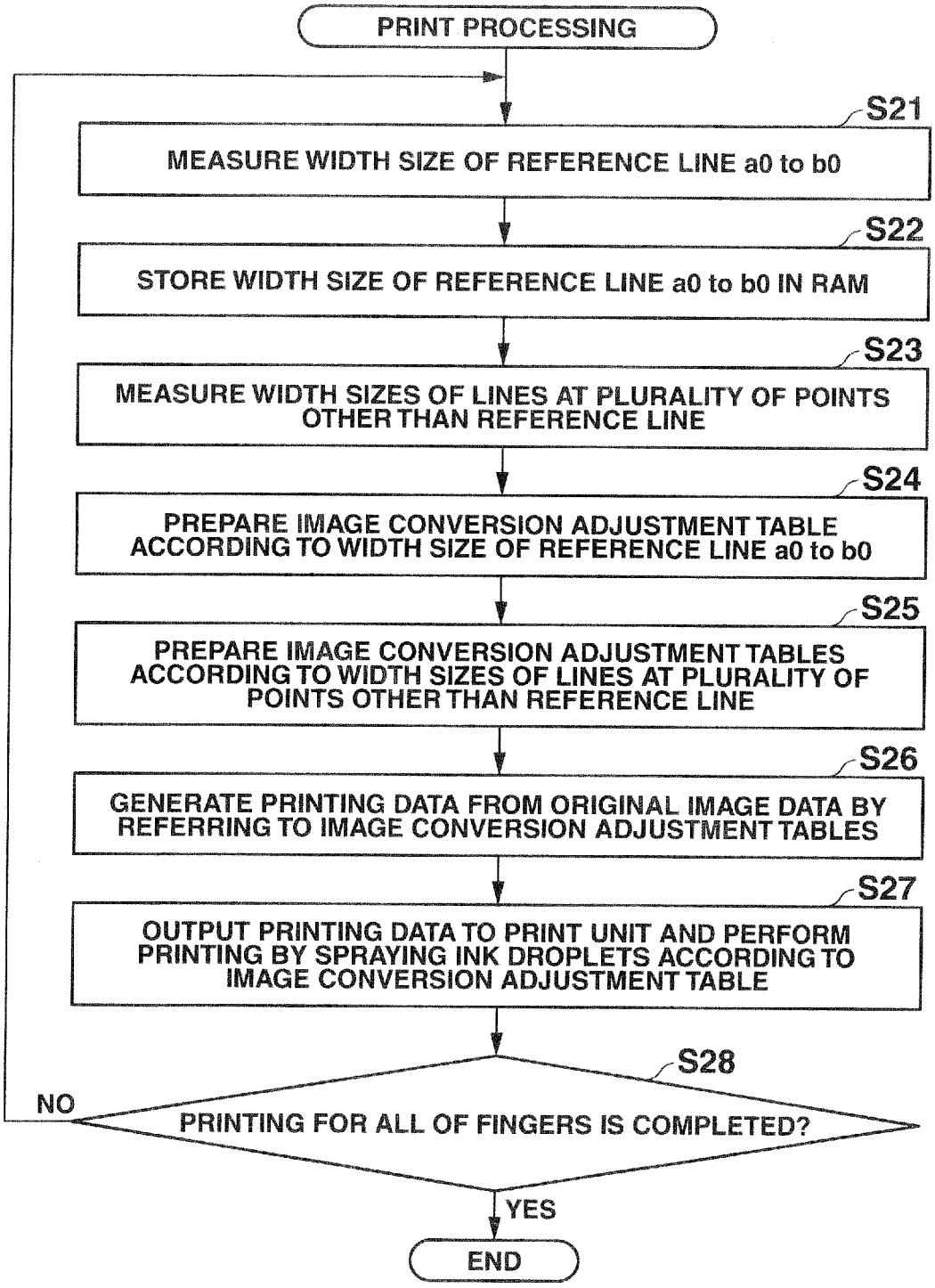
FIG. 31 is a flowchart showing the nail print processing in the print control processing of the second embodiment.

FIG. 31 is a flowchart showing the nail print processing to be performed in the print control processing in this embodiment.

As shown in FIG. 31, in the nail print processing (see step S7 of FIG. 23) of this embodiment, the width measuring unit 511 first measures the length (width size) of a line which is to be the reference in the width direction of the nail portion (in this embodiment, the reference line a0 to b0 which is the line connecting the stress points SpL and SpR) (step S21).

Next, the measured width size is stored in the storage unit such as the RAM or the like (step S22).

The width measuring unit 511 measured the width sizes of lines at plurality of pints other then the reference line and stores the measured width sizes in the storage unit such as the RAM or the like (step S23).

Next, the adjustment table preparing unit 514 first prepares the image conversion adjustment tables of a0 to b0 (see FIGS. 25 and 26) according to the length of the reference line (in this embodiment, the reference line a0 to b0) based on the image conversion basis table (step S24).

Further, the adjustment table preparing unit 514 prepares the image conversion adjustment table (see FIG. 27) corresponding to the width size of a line at the plurality of points other than the reference line (step S25).

Then, the printing data generation unit 515 refers to the generated image conversion adjustment tables to generate printing data from an original image data (step S26).

The print control unit 516 output the printing data to the print unit 40 and performs printing by spraying ink according to the number of pieces of printing pixel group data indicated in the image conversion adjustment table from the recording head 46 (step S27).

Here, other processing is similar to that in the first embodiment. Therefore, the description is omitted.

As described above, according to this embodiment, the image conversion basis table as a pitch adjustment basis table which is set so that the printing pitch for the printing unit 40 to perform printing is smaller in the edge parts of the nail region in is width direction than in the center part of the nail region in its width direction, the nail region being the print target surface, is provided, and the printing data corresponding to the width size of the nail region image of a user is generated from the original image data according to the image conversion basis table to perform printing on the nail portion T.

In such way, even in the case where printing is to be performed to a print target subject (nail portion T) including a print target surface (nail region Ta) having a curve-shape wherein the distance from the print unit 40 in the ink spraying direction is small at the center part in the width direction and becomes greater as approaching the edge parts in the width direction as in a nail portion T of a human finger, high quality image in which decreasing in printing density and generation of stretches and deformations in the design are controlled can be printed.

A plurality of image conversion basis tables (in this embodiment, three types corresponding to the nail shape patterns A to C) according to the height of the print target subject (nail portion T) are provided as the pitch adjustment basis tables, and the image conversion table that matches the height of the nail portion T of a user is to be selected. Therefore, the pitch adjustment (allocation adjustment of the number of pieces of printing pixel group data) matching the shape of the nail portion T of a user can be performed. Therefore, high quality image can be printed by controlling the decreasing in print density and the generation of stretching, deformation and the like in design.

In this embodiment, individual image conversion adjustment table (pitch adjustment table) which is to be applied in printing to the nail region (print target surface) corresponding to the length size of the nail region image (print target region image) in its width direction is prepared by the adjustment table preparing unit 514 based on the image conversion basis table (pitch adjustment basis table). Therefore, merely the individual image conversion adjustment table (pitch adjustment table) is needed to be referred to when the printing data is to be generated, and the print processing can be performed in a simple manner and the time required for the print processing can be shortened.

The embodiments of the present inventions are described above. However, the present invention is not limited to the embodiments and can be modified in various ways within the scope of the invention.

For example, in the above embodiments, the example wherein the shape of the nail portion T of a user is categorized into one of the three nail shape patterns A, B and C and three types of pitch adjustment basis tables corresponding to the nail shape patterns A, B and C are provided. However, categorization of the shape of the nail portion T of a user into one of three types of nail shape patterns A, B or C is not required in the present invention.

For example, only one type of spraying frequency basis table or image conversion basis table can be provided as a pitch adjustment basis table and the printing pitch for the print unit 40 to perform the printing can be adjusted so as to be smaller in the edge parts in the nail region in its width direction than in the center part of the nail region in its width direction based on the one type of the spraying frequency basis table or image conversion basis table, the nail region being the print target surface.

In such case, there is no need to obtain the size of the nail portion T in its height direction. When the nail region image is obtained by the photographing unit 30, printing data corresponding to the length size of the nail region Ta of a user in its width direction is generated from the original image data by referring to the pitch adjustment basis and the nail print processing can be performed according to the printing data.

In the above embodiments, the spraying frequency adjustment table or the image conversion adjustment table for the reference line a0 to b0 is prepared as the pitch adjustment table which is to be the reference (the spraying frequency adjustment table of the image conversion adjustment table). Further, individual spraying frequency adjustment table or image conversion adjustment table is prepared for each of the first line a1 to b2 and the second line a2 to b2. Examples in which printing data is to be generated by referring to the above spraying frequency adjustment tables or image conversion adjustment tables are described. However, preparing of tables other than the spraying frequency adjustment table or the image conversion adjustment table of the reference line a0 to b0 is not required in the present invention.

After preparing the spraying frequency adjustment table or the image conversion adjustment table which is to be the reference, printing can be performed by setting the spraying frequency of ink droplets or the number of pieces of printing pixel group data to be allocated according to the width size for each printing part by referring to the spraying frequency adjustment table or the image conversion adjustment able which is to be the reference at the time of printing.

Moreover, the printing data according to the length size of the nail region Ta of a user in its width direction can be generated from the original image data by directly referring to the spraying frequency basis table or the image conversion basis table as the pitch adjustment basis table without preparing the spraying frequency adjustment table or the image conversion adjustment table which is to be the reference, and the nail print processing can be performed according to the printing data.

In other words, the spraying frequency or the number of printing pixels to be allocated can be obtained for each time from each value in the pitch adjustment basis table, the printing width and the printing position.

Moreover, in the above case, the spraying frequency or the number of printing pixels to be allocated can vary linearly every time with respect to each printing position. In such case, there is no need to provide the adjustment table preparing unit 514.

Further, the print control unit 516 can output the printing data to be print unit 40 by referring to the pitch adjustment basis table or the pitch adjustment table generated based on the pitch adjustment basis table as needed at the time of printing without having the print data generation unit 515.

Moreover, the spraying frequency adjustment table or the image conversion adjustment table is a table in which a value is set with respect to each position of the segment regions in the horizontal direction, each of the segments regions having the width of 100 μm. However, the spraying frequency adjustment table or the image conversion adjustment table can be a data table for one line matching the spraying resolution of the print unit 40.

As described above, the spraying frequency basis table is provided in the first embodiment as the pitch adjustment basis table and the image conversion basis table is provided in the second embodiment as the pitch adjustment basis table. However, the pitch adjustment basis table is not limited to either one of the spraying frequency basis table and the image conversion basis table, and the spraying frequency basis table and the image conversion basis table can be used in combination.

For example, in the case where the image conversion basis table is to be provided as the pitch adjustment basis table, there is no need to adjust the spraying frequency when printing is carried out without performing thinning of the image data, and it is sufficient that all of the printing is performed in similar manner as in the flat part. However, when the printing resolution of the print unit 40 is not enough, thinning of the image data needs to be performed. In such case, it is preferred to adjust so that the printing density in the part where thinning of the image data is performed does not be degraded by adjusting the spraying frequency of ink droplets by using the spraying frequency basis table in combination.

Alternatively, the spraying frequency basis table can be used as the image conversion basis table.

In the above embodiments, the cases where the height size of the nail portion (print target subject) is measured by analyzing the image obtained by radiating slit lights or spot lights from sides in the photographing unit 30 is shown as examples of the methods for measuring the height size of the nail region Ta (print target surface) of the nail portion (print target subject). However, the method for measuring the height size of the nail region Ta of the nail portion T (print target subject) is not limited the example and other method can be used.

Figure 32A:
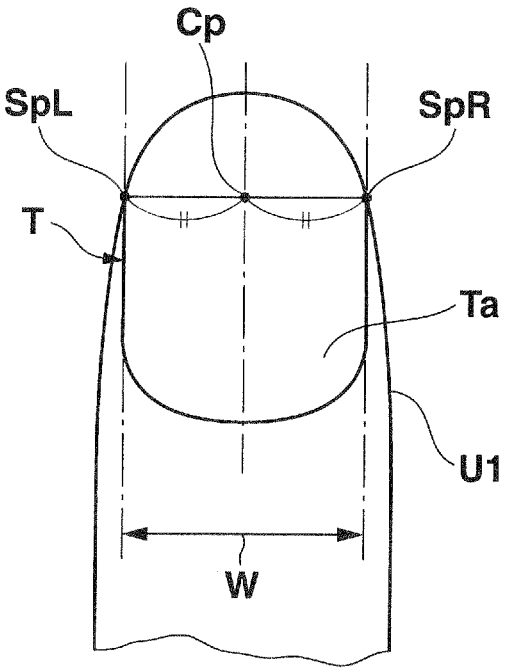
FIG. 32A is a top view of a finger showing a reference point.
Figure 32B:
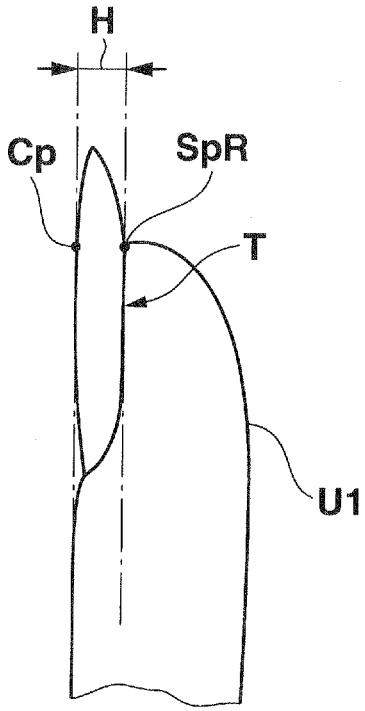
FIG. 32B is a side view of a finger when the finger shown in FIG. 32A is seen from a side.

FIG. 32A is an upper view of a finger in which a reference point is shown and FIG. 32B is a side view of the finger shown in FIG. 32A when it is seen from a side.

Figure 33A:
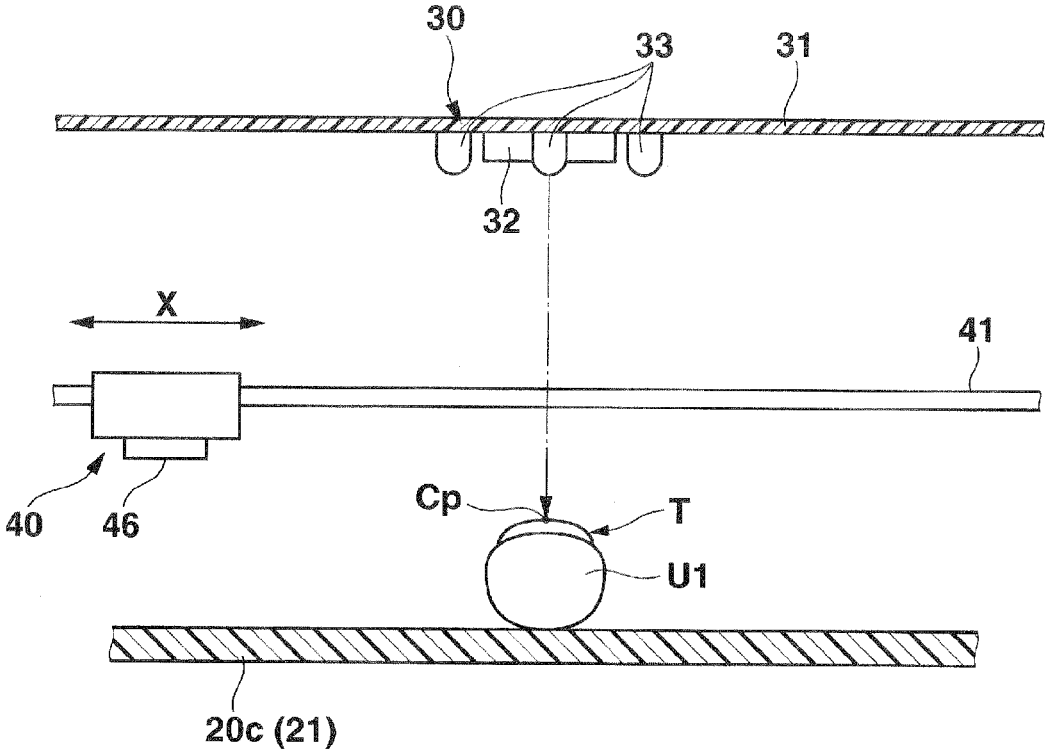
FIG. 33A is a cross-sectional diagram showing a condition where the reference point is photographed from above.
Figure 33B:
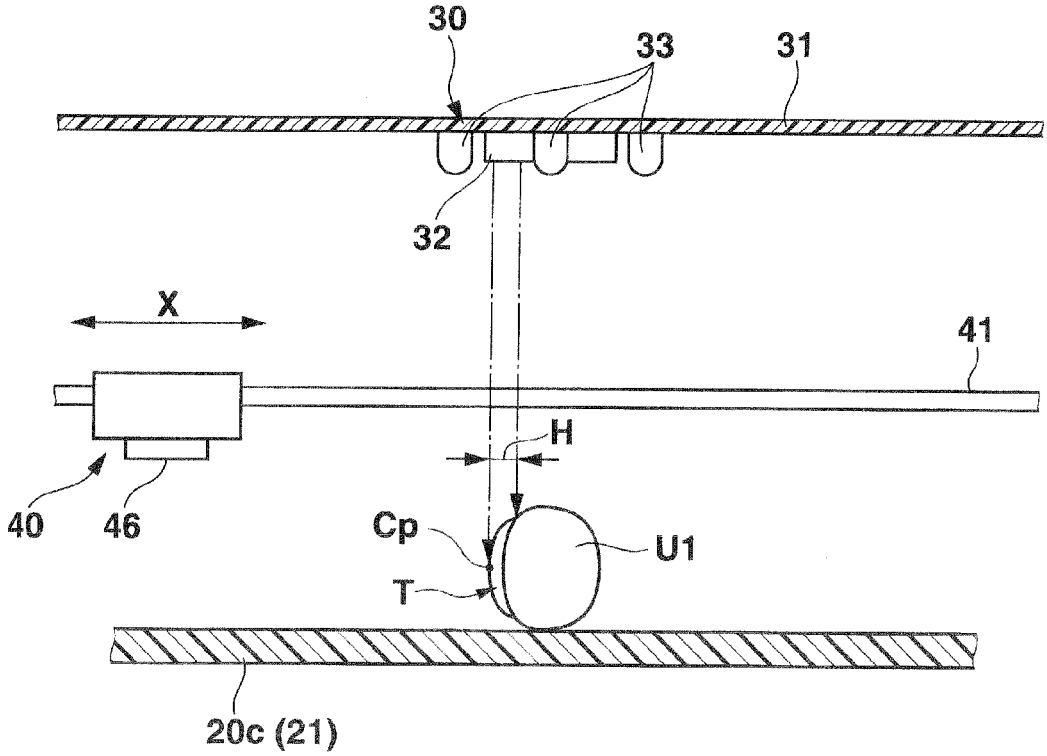
FIG. 33B is a cross-sectional view showing a condition where the finger shown in FIG. 33A is rotated to be on its side.

FIG. 33A is a cross-sectional view showing a condition where the reference point is to be photographed from above, and FIG. 33B is a cross-sectional view showing a condition where the finger shown in FIG. 33A is rotated to be on its side.

Figure 34:
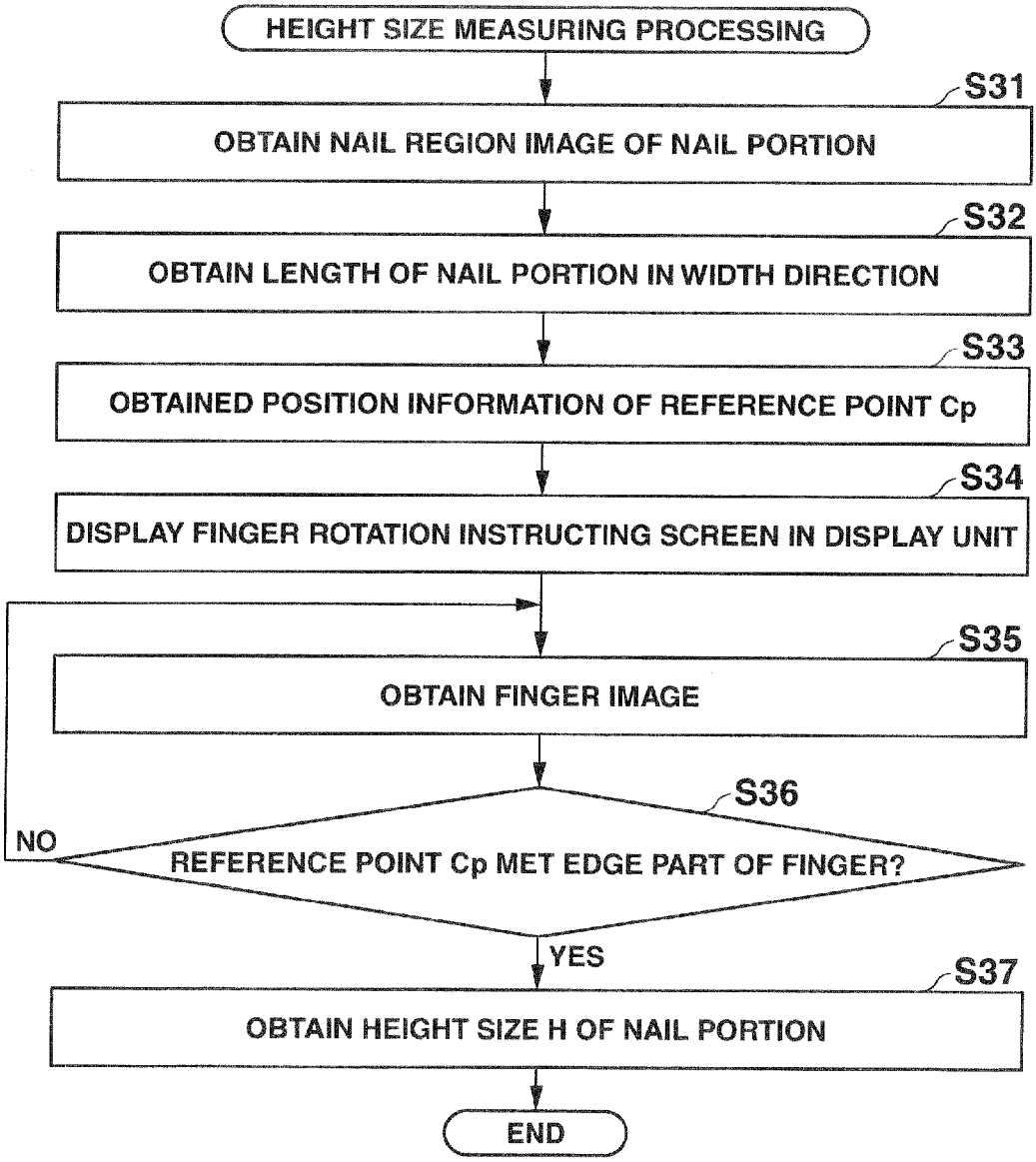
FIG. 34 is a flowchart showing the processing to measure the height size of the nail portion.

FIG. 34 is a flowchart showing the processing for measuring the height size of the nail portion.

Figure 35:
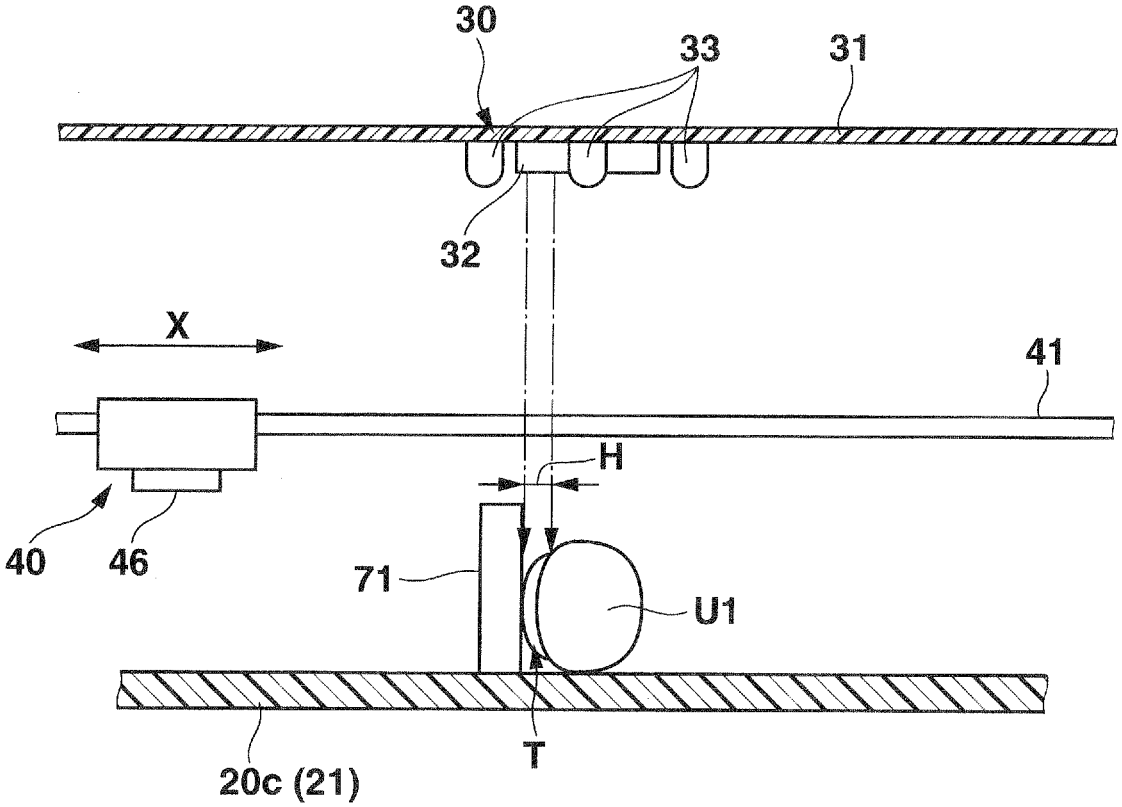
FIG. 35 is a cross-sectional diagram showing a modified example of the unit for measuring the height size of the nail portion shown in FIGS. 33A and 33B.

FIG. 35 is a cross-sectional view showing a modified example of a unit for measuring the height size of the nail portion shown in FIGS. 33A and 33B.

In this modified example, as shown in FIGS. 32A and 33A, the center point of the line connected the stress points SpL and SpR in the nail portion T is recognized by the camera 32 or the like as the reference point Cp first, and then, the image thereof is obtained. Maintaining the condition, a user rotates the finger in the clock-wise direction or in the counter clock-wise direction. At this time, the position of the reference point Cp is followed by the camera 32 or the like. Then, as shown in FIGS. 32B and 33B, the stat where the reference point Cp meets the edge part, that is, the state where the finger is on its side is recognized and photographed. The size of the nail portion T in its height direction is obtained from the photographed image.

In such case, as shown in FIG. 34, a user inserts the nail portion of a finger which is the print target in to the printing finger insertion unit 20*a*, first. When the nail portion of the finger which is to be the print target is inserted in the printing finger insertion unit 20*a*, the nail region image is obtained by the photographing unit 30 (step S31).

Next, the length size between the stress points SpL and SpR in the nail portion T in its width direction, for example, is obtained by the width measuring unit 511 (step S32).

Then, the position information of the reference point Cp which is center point in the line connecting the stress points SpL and SpR is obtained (step S33).

Thereafter, the finger rotation instructing screen for instructing a user to rotate the finger is displayed in the display unit 13 (step S34).

The photographing unit 30 obtains the image of the finger being rotated as needed (step S35).

The control unit 51 determines whether the reference point Cp met the edge part of the image from the images as needed (step S36).

When it is determined that the reference point Cp is not at the edge part of the finger image (step S36; NO), the obtaining of finger images by the photographing unit 30 (step S35) and the determination of step S36 are repeated.

On the other hand, when it is determined that the reference point Cp met the edge part of the finger image (step S36; YES), the length between the reference point Cp and the stress point SpL/SpR in the nail portion T as of this timing are obtained as the size H of the nail portion T in its height direction (see FIG. 32B) (step S37).

For example, as shown in FIG. 35, photographing by the photographing unit 30 can be performed by fixing the finger in the state of being on its side by providing the apparatus with a jig 51 which can support the finger in the state of being on its side. In such case, by the photographing unit 30 photographing the finger in the state being on its side, the length between the reference point Cp and the stress point SpL/SpR of the nail portion T can be obtained as the size H (see FIG. 32B) of the nail portion T in its height direction. In such case, there is no need for a user to rotate the finger.

The height measuring unit 512 may measure the height sizes of a plurality of points with respect to the nail portion T which is the print target subject. In such case, the spraying frequency basis table (pitch adjustment basis table) corresponding to the height can be used for each of the parts having different heights.

By sensitively changing the spraying frequency basis table (pitch adjustment table) according to the height, pitch adjustment that further matches the shape of the nail portion T of a user can be performed and high quality image can be printed by controlling the decreasing in print density and the generation of stretching and deformation in the design.

Other aspects of the present invention are also not limited to the embodiments and arbitrary changes can be made.

Some embodiments of the present invention are described above. However, the scope of the present invention is not limited to the above described embodiments and the scope of the present invention includes the scope described in the claims and the equivalents thereof.

What is claimed is:

1. A print apparatus which performs printing for a print target surface of a print target subject, comprising:

a selection unit which categorizes a shape curved shape of the print target surface into one specific shape pattern among a plurality of shape patterns whose degrees of curving are different from each other, where a center part of the print target surface along a first direction is raised higher than edge parts of the print target surface along the first direction;

a print unit which has a recording head that applies ink on the print target surface; and a control unit which controls the print unit to set an ink amount to be applied at the edge parts of the print target surface to a predetermined amount which is set corresponding to the specific shape pattern;

wherein the control unit comprises a height measuring unit which measures a height of the print target surface as a height size from an edge part at a position which is toward the center part for a predetermined reference distance from the edge part in the first direction; and wherein the selection unit categorizes the curved shape of the print target surface based on a comparison between a value of the height size and predetermined threshold values for the height size, where the threshold values for the height size are set to different values from each other according to the plurality of shape patterns.

2. The print apparatus according to claim 1, further comprising:

a photographing unit which obtains a print target region image by photographing the print target surface of the print target subject, wherein the height measuring unit measures the height size based on an analysis of the print target region image.

3. The print apparatus according to claim 1, wherein:

the recording head intermittently sprays ink droplets to the print target surface while moving along the first direction and forms a plurality of dots on the print target surface, where each of the dots is formed with at least one ink droplet, and the control unit sets a value of a printing pitch of the print unit at the edge parts of the print target surface to a value which is set corresponding to the specific shape pattern and controls the recording head to form one of the dots each time that the recording head moves a distance corresponding to the printing pitch along the first direction.

4. The print apparatus according to claim 3, wherein the control unit comprises:

an original image data storage unit in which image data of an image to be printed on the print target surface is stored as original image data, the image data being formed with a plurality of printing pixels where one printing pixel corresponding to one ink droplet; and a basis table storage unit in which an image conversion basis table for reallocating the plurality of printing pixels of the original image data is stored, wherein in the image conversion basis table, values for a number of printing pixels to be allocated corresponding respectively to segment regions are stored with respect to each of the plurality of shape patterns, where the segment regions are formed by dividing a region which is from one end toward the center part for a predetermined first distance along the first direction for every certain length of the print target surface, and wherein the number of printing pixels to be allocated is set to be greater as an inclined angle of the print target surface corresponding to each of the segment regions along the first direction increases.

5. The print apparatus according to claim 4, further comprising:

a width measuring unit which measures a plurality of width sizes between the edge parts along the first direction in the print target surface at a plurality of measuring points provided along a second direction that is orthogonal to the first direction, wherein the control unit comprises an adjustment table preparing unit which prepares a plurality of image conversion adjustment tables corresponding respectively to the measurement points, wherein in each of the image conversion adjustment tables, the values for the number of printing pixels to be allocated corresponding respectively to the segment regions are stored, where the segment regions are formed by dividing a region between the edge parts along the first direction corresponding to each of the measuring points of the print target surface, and wherein the adjustment table preparing unit prepares a first image conversion adjustment table that corresponds to one specific measuring point among the plurality of measuring points based on the number of printing pixels to be allocated stored in the image conversion basis table corresponding to the specific shape pattern, and prepares a second image conversion adjustment table that corresponds to another measuring point among the plurality of measuring points excluding the specific measuring point by correcting the first image conversion adjustment table according to a ratio between a first width size value at the specific measuring point and a second width size value at the another measuring point.

6. The print apparatus according to claim 5, wherein the control unit comprises:

a printing data generation unit which generates printing data corresponding to the width sizes from the original image data by referring to the image conversion adjustment tables, where the plurality of printing pixels of the printing data are reallocated to a value of the number of printing pixels stored in the image conversion adjustment tables with respect to each of the segment regions; and a print control unit which supplies the generated printing data to the print unit.

7. The print apparatus according to claim 1, wherein the print target subject is a nail portion of a finger of a person, the print target surface is a nail region, and the print unit performs nail printing on a surface of the nail portion of the person.

8. A print apparatus, which performs printing for a print target surface of a print target subject, comprising:

a selection unit which categorizes a curved shape of the print target surface into one specific shape pattern among a plurality of shape patterns whose degrees of curving are different from each other, where a center part of the print target surface along a first direction is raised higher than edge parts of the print target surface along the first direction;

a print unit which has a recording head that applies ink on the print target surface; and a control unit which controls the print unit to set an ink amount to be applied at the edge parts of the print target surface to a predetermined amount which is set corresponding to the specific shape pattern;

wherein the recording head intermittently sprays ink droplets to the print target surface while moving along the first direction and forms a plurality of dots on the print target surface, where each of the dots is formed with at least one ink droplet, wherein the control unit sets a value of a printing pitch of the print unit at the edge parts of the print target surface to a value which is set corresponding to the specific shape pattern and controls the recording head to form one of the dots each time that the recording head moves a distance corresponding to the printing pitch along the first direction, wherein the control unit includes a basis table storage unit for storing which stores a spraying frequency basis table for setting a spraying frequency of the ink droplets to be sprayed from the recording head that corresponds to the printing pitch, wherein the spraying frequency basis table stores first setting values of the spraying frequency corresponding respectively to segment regions with respect to each of the plurality of shape patterns, where the segment regions are formed by dividing a region which is from one end toward the center part for a predetermined first distance along the first direction for every certain length of the print target surface, and wherein the first setting values are set so as to increase a ratio of the first setting value with respect to a spraying frequency basis value to be greater than 1 according to an increase of an inclined angle of the print target surface corresponding to each of the segment regions along the first direction, where the spraying frequency basis value is set to the spraying frequency to be set in the recording head when the print target surface is parallel to the first direction.

9. The print apparatus according to claim 8, further comprising:

a width measuring unit which measures a plurality of width sizes between the edge parts along the first direction in the print target surface at a plurality of measuring points provided along a second direction that is orthogonal to the first direction, wherein the control unit comprises an adjustment table preparing unit which prepares a plurality of spraying frequency adjustment tables, each of which corresponds to one of the measurement points, and wherein the spraying frequency adjustment tables store second setting values of the spraying frequency corresponding respectively to the segment regions, where the segment regions are formed by dividing a region between the edge parts along the first direction corresponding to each of the measuring points of the print target surface, and wherein the adjustment table preparing unit prepares a first spraying frequency adjustment table that corresponds to one specific measuring point among the plurality of measuring points based on the first setting values stored in the spraying frequency basis table corresponding to the specific shape pattern, and prepares a second spraying frequency adjustment table that corresponds to another measuring point among the plurality of measuring points excluding the specific measuring point by correcting the first spraying frequency adjustment table according to a ratio between a first width size value at the specific measuring point and a second width size value at the another measuring point.

10. The print apparatus according to claim 9, wherein the control unit comprises:

an original image data storage unit in which image data of an image to be printed on the print target surface is stored as original image data;

a printing data generation unit which generates printing data corresponding to the width sizes from the original image data by referring to the spraying frequency adjustment tables, where the spraying frequency of the printing data is set to values corresponding to the second setting values stored in the spraying frequency adjustment tables; and a print control unit which thins out a portion of the printing data based on the second setting values stored in the spraying frequency adjustment tables and supplies the thinned out printing data to the print unit.

11. A print control method for a print apparatus which performs printing on a print target surface of a print target subject, the print control method comprising:

categorizing a curved shape of a print target surface into one specific shape pattern among a plurality of shape patterns whose degrees of curving are different from each other, where a center part of the print target surface along a first direction is raised higher than edge parts of the print target surface along the first direction; and setting an ink amount to be applied at the edge parts of the print target surface to a predetermined amount which is set corresponding to the specific shape pattern by controlling a print unit which has a recording head that applies ink on the print target surface;

wherein the categorizing comprises measuring a height of the print target surface as a height size from an edge part at a position which is toward the center part for a predetermined reference distance from the edge part along the first direction, and categorizing the curved shape of the print target surface based on a comparison between a value of the height size and predetermined threshold values of the height size, where the threshold values for the height size are set to different values from each other according to the plurality of shape patterns.

12. The print control method according to claim 11, further comprising:

spraying ink droplets intermittently to the print target surface while moving the recording head along the first direction and forming a plurality of dots each of which is formed with at least one ink droplet on the print target surface, and setting a value of a printing pitch at the edge parts of the print target surface to a value which is set corresponding to the specific shape pattern and forming one of the dots each time that the recording head is moved a distance corresponding to the printing pitch along the first direction.

13. The print control method according to claim 12, further comprising:

measuring a plurality of width sizes between the edge parts along the first direction in the print target surface at a plurality of measuring points provided along a second direction that is orthogonal to the first direction; and preparing a spraying frequency basis table and a plurality of spraying frequency adjustment tables corresponding respectively to the measuring points, wherein:

the spraying frequency basis table stores first setting values of the spraying frequency corresponding respectively to segment regions with respect to each of the plurality of shape patterns, where the segment regions are formed by dividing a region which is from one end toward the center part for a predetermined first distance along the first direction for every certain length of the print target surface, each of the spraying frequency adjustment tables stores second setting values of the spraying frequency corresponding respectively to the segment regions, where the segment regions are formed by dividing a region between the edge parts along the first direction corresponding to each of the measuring points of the print target surface, the first setting values stored in the spraying frequency basis table are set so as to increase a ratio of the first setting value with respect to a spraying frequency basis value to be greater than 1 according to an increase of an inclined angle of the print target surface corresponding to each of the segment regions along the first direction, where the spraying frequency basis value is set to the spraying frequency to be set in the recording head when the print target surface is parallel to the first direction, and the plurality of spraying frequency adjustment tables include a first spraying frequency adjustment table that corresponds to one specific measuring point among the plurality of measuring points based on the first setting values stored in the spraying frequency basis table corresponding to the specific shape pattern, and a second spraying frequency adjustment table corresponding to another measuring point among the plurality of measuring points excluding the specific measuring point, said second spraying frequency adjustment table being prepared by correcting the first spraying frequency adjustment table according to a ratio between a first width size value at the specific measuring point and a second width size value at the another measuring point.

14. The print control method according to claim 13, further comprising:

generating printing data corresponding to the width sizes from an image data of an image to be printed on the print target surface by referring to the spraying frequency adjustment tables, where the spraying frequency of the printing data is set to values corresponding to the second setting values stored in the spraying frequency adjustment tables;

thinning out a portion of the printing data based on the second setting values stored in the spraying frequency adjustment tables; and supplying the thinned out printing data to the print unit and printing to the print target surface.

15. The print control method according to claim 12, further comprising:

measuring a plurality of width sizes between the edge parts along the first direction in the print target surface at a plurality of measuring points provided along a second direction that is orthogonal to the first direction are measured; and preparing an image conversion basis table and a plurality of image conversion adjustment tables corresponding respectively to the measuring points, wherein:

the image conversion basis table stores a number of printing pixels to be allocated corresponding respectively to segment regions with respect to each of the plurality of shape patterns, where the segment regions are formed by dividing a region which is from one end toward the center part for a predetermined first distance along the first direction for every certain length of the print target surface, each of the image conversion adjustment tables stores the number of printing pixels to be allocated corresponding respectively to the segment regions, where the segment regions are formed by dividing a region between the edge parts along the first direction corresponding to each of the measuring points of the print target surface, the number of printing pixels to be allocated stored in the image conversion basis table is set to be greater according to an increase of an inclined angle of the print target surface corresponding to each of the segment regions along the first direction, and the plurality of image conversion adjustment tables include a first image conversion adjustment table that corresponds to one specific measuring point among the plurality of measuring points based on the number of printing pixels to be allocated stored in the image conversion basis table corresponding to the specific shape pattern, and a second image conversion adjustment table corresponding to another measuring point among the plurality of measuring points excluding the specific measuring point, said second image conversion adjustment table being prepared by correcting the first image conversion adjustment table according to a ratio between a first width size value at the specific measuring point and a second width size value at the another measuring point.

16. The print control method according to claim 15, further comprising:

generating printing data corresponding to the width size from an image data to be printed on the print target surface by referring to the image conversion adjustment table, where the plurality of printing pixels of the printing data are reallocated to a value of the number of printing pixels stored in the image conversion adjustment table with respect to each of the segment regions; and supplying the printing data to the print unit and printing to the print target surface.

* * * * *

UNITED STATES PATENT AND TRADEMARK OFFICE

CERTIFICATE OF CORRECTION

PATENT NO. : 8,814,289 B2
APPLICATION NO. : 13/458493
DATED : August 26, 2014
INVENTOR(S) : Shuichi Yamasaki It is certified that error appears in the above-identified patent and that said Letters Patent is hereby corrected as shown below:

In the Claims:

Column 33, Claim 1, Line 15:

delete "shape curved shape" and insert --curved shape--.

Column 34, Claim 8, Line 62:

delete "apparatus," and insert --apparatus--.

Signed and Sealed this
Third Day of February, 2015

Michelle K. Lee

Michelle K. Lee
*Deputy Director of the United States Patent and Trademark Office*